US009911265B2

(12) United States Patent
Lee et al.

(10) Patent No.: US 9,911,265 B2
(45) Date of Patent: Mar. 6, 2018

(54) FINANCIAL DEVICE

(71) Applicant: LG CNS Co., Ltd., Seoul (KR)

(72) Inventors: Su Min Lee, Seoul (KR); Chang Ho Moon, Seoul (KR); Jeong Rok Hwang, Seoul (KR)

(73) Assignee: LG CNS CO., LTD., Seoul (KR)

( * ) Notice: Subject to any disclaimer, the term of this patent is extended or adjusted under 35 U.S.C. 154(b) by 0 days.

(21) Appl. No.: 14/959,386

(22) Filed: Dec. 4, 2015

(65) Prior Publication Data

US 2016/0163144 A1 Jun. 9, 2016

(30) Foreign Application Priority Data

Dec. 4, 2014 (KR) ..... 10-2014-0172721
Apr. 20, 2015 (KR) ..... 10-2015-0055537

(51) Int. Cl.

| | |
|---|---|
| ***B65H 85/00*** | (2006.01) |
| ***G07D 11/00*** | (2006.01) |
| ***B65H 7/18*** | (2006.01) |
| ***B65H 29/00*** | (2006.01) |
| ***B65H 43/04*** | (2006.01) |

(52) U.S. Cl.

CPC ..... *G07D 11/0033* (2013.01); *B65H 7/18* (2013.01); *B65H 29/00* (2013.01); *B65H 43/04* (2013.01); *G07D 11/006* (2013.01); *G07D 11/0036* (2013.01); *G07D 11/0084* (2013.01); *B65H 85/00* (2013.01)

(58) Field of Classification Search

CPC ..... G07D 7/00; G07D 11/00; B65H 85/00
See application file for complete search history.

(56) References Cited

U.S. PATENT DOCUMENTS

| | | | |
|---|---|---|---|
| 8,272,563 | B1 | 9/2012 | Folk et al. |
| 2007/0228152 | A1 | 10/2007 | Washington et al. |
| 2010/0025911 | A1 | 2/2010 | Sakamoto |
| 2012/0285787 | A1 | 11/2012 | Hosokawa et al. |

FOREIGN PATENT DOCUMENTS

| | | | |
|---|---|---|---|
| CN | 101847290 | A | 9/2010 |
| CN | 102013124 | A | 4/2011 |
| CN | 102779368 | A | 11/2012 |
| CN | 203950393 | U | 11/2014 |
| JP | 05-054222 | A | 3/1993 |

(Continued)

OTHER PUBLICATIONS

Office Action dated Apr. 25, 2016 in Korean Application No. 1020140172721.

(Continued)

*Primary Examiner* — Howard Sanders
(74) *Attorney, Agent, or Firm* — Saliwanchik, Lloyd & Eisenschenk

(57) ABSTRACT

Provided is a financial device. The financial device comprises an upper module and a lower module disposed under the upper module. The upper module comprises a medium depositing and withdrawing unit through which media to be counted, media to be deposited, and media to be withdrawn are accepted and withdrawn and a discrimination unit connected to the medium depositing and withdrawing unit through a transfer path. The lower module comprises an additional function cassette and a medium storage unit which are capable of storing media.

15 Claims, 24 Drawing Sheets

(56) References Cited

FOREIGN PATENT DOCUMENTS

| | | | |
|---|---|---|---|
| JP | 2002109604 | A | 4/2002 |
| JP | 2004013864 | A | 1/2004 |
| JP | 2006-260413 | A | 9/2006 |
| JP | 2007072973 | A | 3/2007 |
| JP | 4830414 | B2 | 12/2011 |
| JP | 2012155752 | A | 8/2012 |
| JP | 2013257907 | A | 12/2013 |
| JP | 2014102545 | A | 6/2014 |
| JP | 2014112440 | A | 6/2014 |
| JP | 2014142845 | A | 8/2014 |
| JP | 2014220015 | A | 11/2014 |
| KR | 100235074 | B1 | 12/1999 |
| KR | 10-2007-0029908 | A | 3/2007 |
| KR | 20090069702 | A | 7/2009 |
| KR | 10-2013-0030932 | A | 3/2013 |
| KR | 20130090970 | A | 8/2013 |
| KR | 101310499 | B1 | 9/2013 |
| KR | 101456367 | B1 | 11/2014 |
| RU | 2299466 | C2 | 5/2007 |

OTHER PUBLICATIONS

Office Action dated Jul. 7. 2016 in Korean Application No. 1020150055537.

European Search Report dated May 6, 2016 in European Application No. 15197816.0.

Office Action dated Feb. 14, 2017 in Russian Application No. 2015151965/28(080056).

Office Action dated Feb. 7, 2017 in Japanese Application No. 2015-237563.

Notice of Allowance dated Oct. 26, 2016 in Korean Application No. 10-2014-0172721.

Russian Official Decision of Grant dated Jun. 22, 2017 in Russian Application No. 2015151965/28.

Office Action dated Sep. 5, 2017 in Chinese Application No. 201510882594.8.

Office Action dated May 22, 2017 in Korean Application No. 10-2015-0055537.

Office Action dated Oct. 23, 2017 in Japanese Application No. 2015-237563.

FINANCIAL DEVICE

CROSS-REFERENCE TO RELATED APPLICATIONS

This application claims the benefit under 35 U.S.C. § 119 of Korean Patent Application No. 10-2014-0172721, filed Dec. 4, 2014 and 10-2015-0055537, filed Apr. 20, 2015, which are hereby incorporated by reference in their entirety.

BACKGROUND

TECHNICAL FIELD

Generally, financial devices are devices that process a financial transaction that is desired by a customer. The financial devices may deposit/withdrawal a medium or automatically transfer a medium. The financial devices comprise a medium processing apparatus for depositing or withdrawing a medium. The financial devices may be directly manipulated by a customer or manipulated by a teller of the bank.

A paper sheet handling device is disclosed in Japanese Patent Publication No. 2007-310547 (Published Date: Nov. 29, 2007).

The paper sheet handling device comprises a deposit port, a withdrawal port, a temporary stacker for temporarily receiving paper sheets, and a restoration port.

According to the paper sheet handling device as described above, a paper sheet accepted through the deposit port during a counting process may pass through an identification unit and then be transferred to the withdrawal port. Here, a customer may intend to perform the deposit process after the counting. In this case, according to the paper sheet handling device according to the related art, since a counted medium is not separated from the withdrawal port so as to be directly deposited, the teller has to take the medium stacked in the withdrawal port out to insert the medium into the deposit port.

Also, if it is intended to deposit the counted medium, the medium separated from the deposit port may be transferred to a reception unit after being transferred to the temporary stacker to extend a deposit transaction time.

Also, according to the prior document, since a cassette for replenishing does not exist in a safe, if it is intended to replenishment a medium in the reception unit, the medium has to be replenished by using the deposit port or has to be directly replenished after the safe is taken out. Thus, the process may be cumbersome, and the reception unit within the safe may be exposed to deteriorate security.

In addition, according to the prior document, since a medium is temporarily stacked within the single temporary stacker, if it is intended to deposit more media than a maximum medium number which is capable of being stacked at one time in the temporary stacker, the media have to be deposited at least two times. Thus, the deposit transaction time may increase.

BRIEF SUMMARY

Embodiments provide a financial device which is capable of depositing counted media just.

Embodiments also provide a financial device in which the number of media that are temporarily stacked in one transaction increases.

Embodiments also provide a financial device in which an additional function cassette is disposed in a safe to improve security and providing various functions.

Embodiments also provide a financial device in which media that are untaken by a customer are automatically collected to increase an operation rate of the device.

In one embodiment, a financial device comprises: an upper module; and a lower module disposed under the upper module, wherein the upper module comprises: a medium depositing and withdrawing unit through which media to be counted, media to be deposited and media to be withdrawn are accepted and withdrawn; and a discrimination unit connected to the medium depositing and withdrawing unit through a transfer path, and the lower module comprises an additional function cassette and a medium storage unit which are capable of storing media, wherein, through the additional function cassette and the medium storage unit, in the deposit process, media having a predetermined number are stacked in the medium storage unit, and media that are not stored in the medium storage unit are stored in the additional function cassette, in the deposit process, a kind of media, which is different from that of media stored in the medium storage unit is stored in the additional function cassette, information of the media stored in the medium storage unit is discriminated and then compared to information stored in a memory to perform audit, the media in the medium storage unit are automatically collected to the additional function cassette, or the media in the additional function cassette are replenished to the medium storage unit.

In another embodiment, a financial device comprises: an upper module comprising a medium depositing and withdrawing unit through which media to be counted, media to be deposited and media to be withdrawn are accepted and withdrawn and a discrimination unit connected to the medium depositing and withdrawing unit by a transfer path; and a lower module comprising a medium storage unit for storing media, wherein the medium depositing and withdrawing unit comprises: a first space into which the media to be counted and the media to be deposited are accepted; and a second space in which the counted media are stacked, the media passing through the discrimination unit as media to be withdrawn are stacked, and the media passing through the discrimination unit are temporarily stacked in the deposit process, wherein the counted media and the temporarily stacked media among the media stacked in the second space are transferred along the transfer path and stored in the media storage unit.

The details of one or more embodiments are set forth in the accompanying drawings and the description below. Other features will be apparent from the description and drawings, and from the claims.

BRIEF DESCRIPTION OF THE DRAWINGS

FIGS. 3 to 5 views illustrating transfer of the medium in a deposit process according to the first embodiment, wherein FIG. 3 is a view illustrating transfer of the medium in a first deposit process, FIG. 4 is a view illustrating transfer of the medium when a deposit cancel command is inputted, and FIG. 5 is a view illustrating transfer of the medium in a second deposit process.

DETAILED DESCRIPTION

Figure 1:
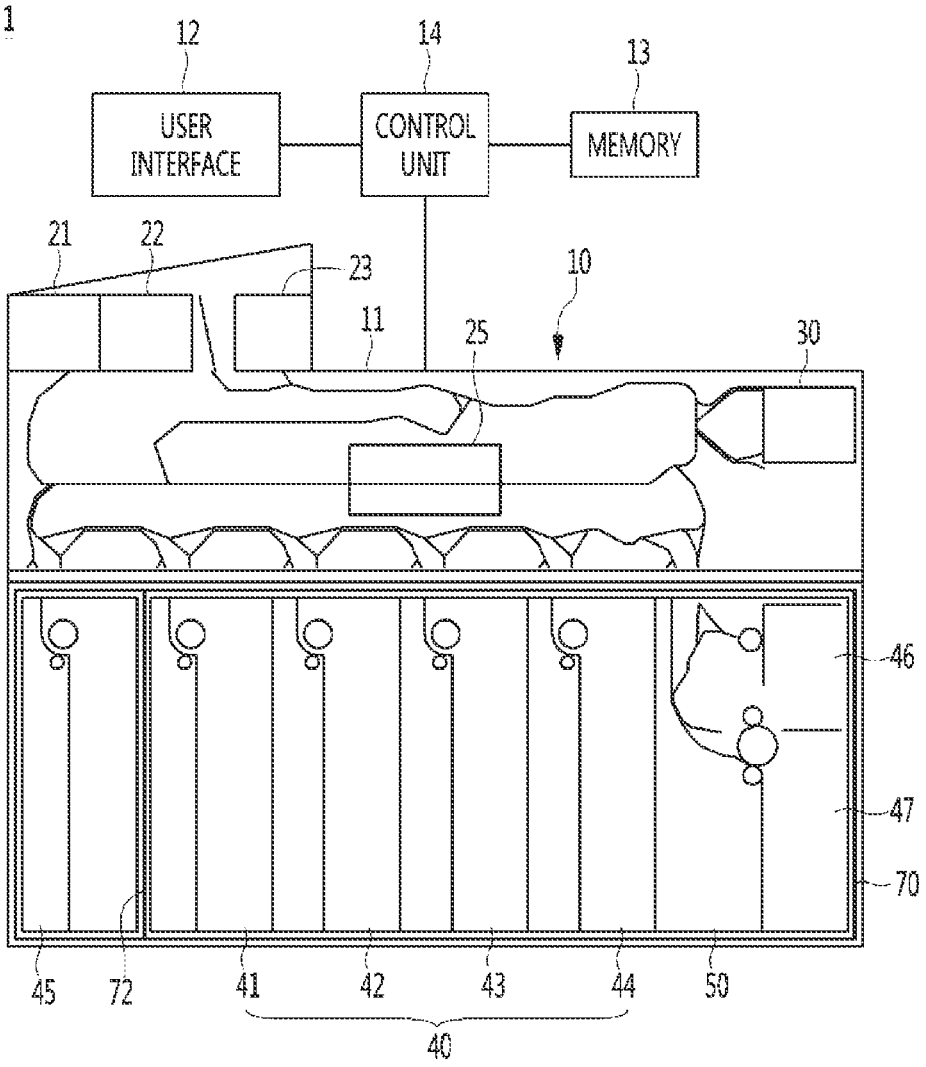
FIG. 1 is a schematic view of a financial device according to a first embodiment.

Hereinafter, exemplary embodiments of the present disclosure will be described with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

A financial device according to embodiments is a device that performs financial businesses, i.e., medium processing comprising processing such as deposit processing, giro receipt, or gift certificate exchange and/or processing such as withdrawal processing, giro dispensing, or gift certificate dispensing by receiving various media such as, e.g., paper moneys, bills, giros, coins, gift certificates, etc. For example, the financial device may comprise an automatic teller machine (ATM) such as a cash dispenser (CD) or a cash recycling device. However, the financial device is not limited to the above-described examples. For example, the financial device may be a device for automatically performing the financial businesses such as a financial information system (FIS).

Hereinafter, assuming that the financial device is the ATM, an embodiment will be described. However, this assumption is merely for convenience of description, and technical idea of the present disclosure is not limited to the ATM.

FIG. 1 is a schematic view of a financial device according to a first embodiment.

Referring to FIG. 1, a financial device 1 according to a first embodiment may comprise a medium processing apparatus 10. The medium processing apparatus 10 may be disposed in a cabinet 11.

The financial device 1 may further comprise a user interface 12 for receiving a command related to a financial transaction such as deposit or withdrawal of a user or displaying information to the user. Here, the user may be a teller of a bank, a manager of the financial device, or a manager or operator of a shop or store.

For example, the user interface 12 may display menu and information for deposit and withdrawal or display information of a counted medium. Also, the user interface 12 may be provided in a shape that is attached to the financial device 1. Alternatively, the user interface 12 may be provided as a separate unit and wired to and/or wirelessly connected to the financial device.

The financial device 1 may further comprise a control unit for controlling the medium processing apparatus 10 and the user interface 12.

The medium processing apparatus 10 may comprise a medium depositing and withdrawing unit through which the user takes a medium in or out.

The medium processing apparatus 10 may further comprise a discrimination unit 25 for discriminating a medium for the deposit, a medium of the withdrawal, or a medium to be counted.

The discrimination unit 25 may distinguish a kind of medium, a state of a medium, identification information of a medium (e.g., a serial number of medium).

The information discriminated by the discrimination unit 25 may be stored in a memory 13.

The medium processing apparatus 10 may further comprise a temporary stacker 30 for temporarily stacking media.

The medium processing apparatus 10 may further comprise a medium storage unit 40 for storing a medium.

The medium storage unit 40 may comprise a plurality of medium cassettes 41 to 44. At least one of the plurality of medium cassettes 41 to 44 may store a bill, and the other one or more may store a check. Alternatively, the whole medium cassettes 41 to 44 may store a bill or a check.

At least one of the plurality of medium cassettes 41 to 44 may store a deposited medium and be used for withdrawing the stored medium. That is, a medium accepted into the at least one of the plurality of medium cassettes 41 to 44 when being deposited may be discharged from a withdrawal unit 22 when being withdrawn.

Thus, in this specification, the medium cassette into which a medium is acceptable and from which a medium is withdrawable may be called a recycle cassette.

The medium processing apparatus 10 may further comprise an additional function cassette 45.

The additional function cassette 45 may store a medium to be replenished in the medium storage unit 40 or a medium to be collected from the medium storage unit 40.

Of cause, the additional function cassette 45 may provide various functions according to user's set in addition to the replenishment or collection function. The various functions or usages of the additional function cassette 45 will be described below.

The medium processing apparatus 10 may further comprise a collection cassette.

The collection cassette may recover a medium that is determined as a faulty medium in a deposit process. Also, the collection cassette may recover a medium that is determined as a faulty medium in a withdrawal process.

In the current embodiment, the collection cassette may be separate cassettes 46 and 47. Alternatively, the collection cassette may be provided as a single cassette of which the inside is spatially divided to recover each of media that are determined as the faulty media in the deposit and withdrawal processes.

For example, FIG. 1 illustrates a structure in which a first cassette 46 and a second cassette 47 are vertically arranged.

The financial device 1 may further comprise a transfer module 50 that guides a medium in a transfer path to the collection cassette and guides a medium discharged from the collection cassette to the transfer path.

The transfer module 50 may be a module separated from the collection cassette or a module provided in the collection cassette.

The financial device 1 may further comprise a safe 70.

The additional function cassette 45, the plurality of medium cassettes 41 to 44, the collection cassettes 46 and 47, and the transfer module 50 may be disposed in the safe 70.

Thus, even though the transfer path is opened to repair or check the transfer path that is disposed outside the safe 70, the access to each of the cassettes 41 to 45 within the safe 70 may be blocked to improve security.

The safe 70 may be partitioned into a first space in which the additional function cassette 45 is disposed and a second space in which the plurality of medium cassettes 41 to 44 and the collection cassettes 46 and 47 are disposed by a partition part 72. The partition part 72 may be a door for opening and closing the second space in which the plurality of medium cassettes 41 to 44 and the collection cassettes 46 and 47 are disposed. Alternatively, the partition part may be omitted in the safe 70. However, dual locking may be required by a first locking unit and a second locking unit which will be described below, regardless of an existence of the partition part 72.

The safe 70 may comprise the first locking unit and a second locking unit. The first locking unit may allow or block the access of the user to the additional function cassette 45. Alternatively, the safe 70 may comprise the first locking unit, and the second locking unit may be disposed on a cassette support supporting the recycle cassette and being withdrawable from the safe 70.

The second locking unit may allow or block the access of the user to the second space in which the plurality of medium cassettes 41 to 44 and the collection cassettes 46 and 47 are disposed.

Thus, when the user releases the first locking unit, the user may be accessible to the additional function cassette 45. Even though the user releases the first locking unit, the access of the user to the second space in which the plurality of medium cassettes 41 to 44 and the collection cassettes 46 and 47 are disposed may be blocked by the second locking unit.

For example, authority for releasing each of the locking units may be different according to the user. For example, a person that does not have the authority for releasing the second locking unit may not release the second locking unit in the state in which the first locking unit is released.

Thus, according to the current embodiment, since the access of the user to the plurality of medium cassettes 41 to 44 and the collection cassettes 46 and 47 is blocked in the process of using the additional function cassette 45, the security may be improved.

The medium depositing and withdrawing unit may comprise a deposit part 21 (or referred to as an "input part") for accepting a medium to be deposited or a medium to be counted and a withdrawal part 22 in which a medium to be withdrawn or a counted medium is stacked.

Although not shown, the deposit part 21 may comprise a separation part for separating media stacked in the deposit part 21 from each other.

The separation part may comprise a pick-up roller for picking a medium up, a feed roller for separating the medium picked up by the pick-up roller into each sheet of medium, and a gate roller. The gate roller may be maintained in a state in which the gate roller rotates in a direction opposite to the feed roller or is stopped.

The medium depositing and withdrawing unit may further comprise a reject part 23 for storing a medium that is not recognized by the discrimination unit 25 or determined as a faulty medium in the counting process and/or deposit process.

In this specification, the medium processing apparatus may comprise an upper module and a lower module. The upper module may comprise the medium depositing and withdrawing unit 20, the discrimination unit 25, and the temporary stacker 30, and the lower module may comprise the additional function cassette 45 and the collection cassettes 46 and 47, Hereinafter, an operation of the financial device according to the first embodiment will be described.

<Counting Process>

Figure 2:
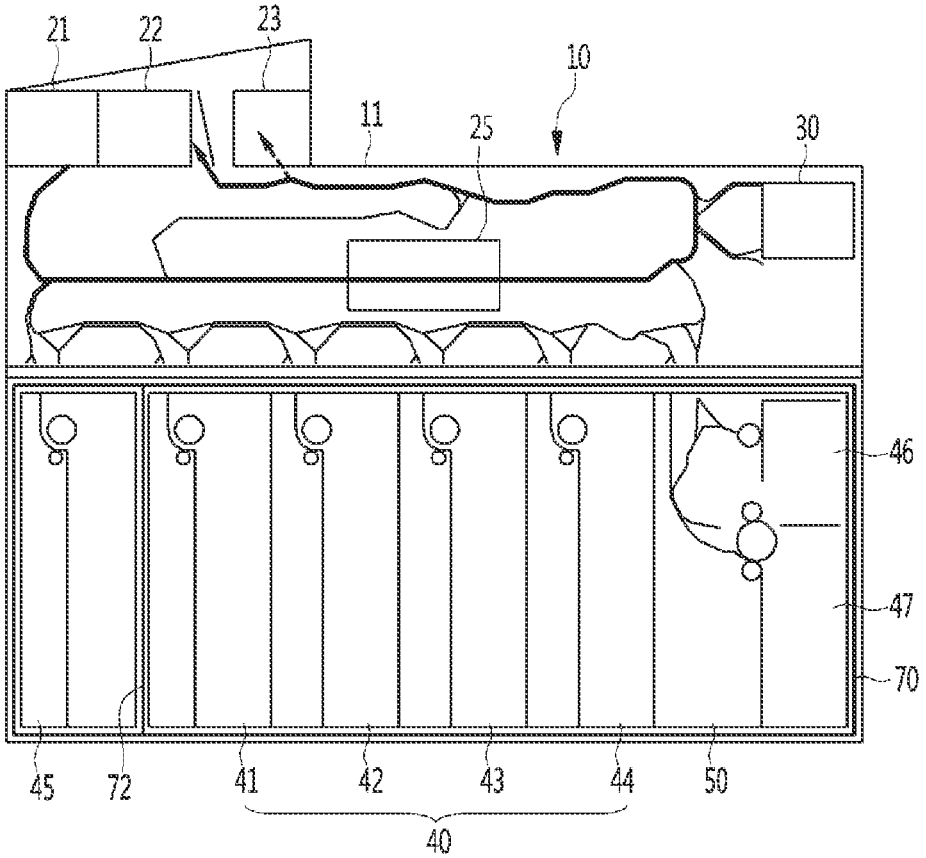
FIG. 2 is a view illustrating transfer of a medium in a counting process according to the first embodiment.

FIG. 2 is a view illustrating transfer of a medium in the counting process according to the first embodiment.

Referring to FIG. 2, to count media, the media may be accepted into the deposit part 21. The medium accepted into the deposit part 21 may be separated from each other into each sheet of media by the separation part. The medium separated into each sheet of media passes through the discrimination unit 25. The discrimination unit 25 may determine a kind of medium and whether the media is normal or abnormal.

The medium that is recognized as the normal medium by the discrimination unit 25 may be transferred to the withdrawal part 22. On the other hand, the medium that is recognized as the abnormal medium by the discrimination unit 25 may be transferred to the reject part 23. In this specification, the medium that is recognized as the abnormal medium may be a medium that is determined as the faulty medium by the discrimination unit 25 or a medium that is not recognized by the discrimination unit 25.

<Deposit Process>

Figure 3:
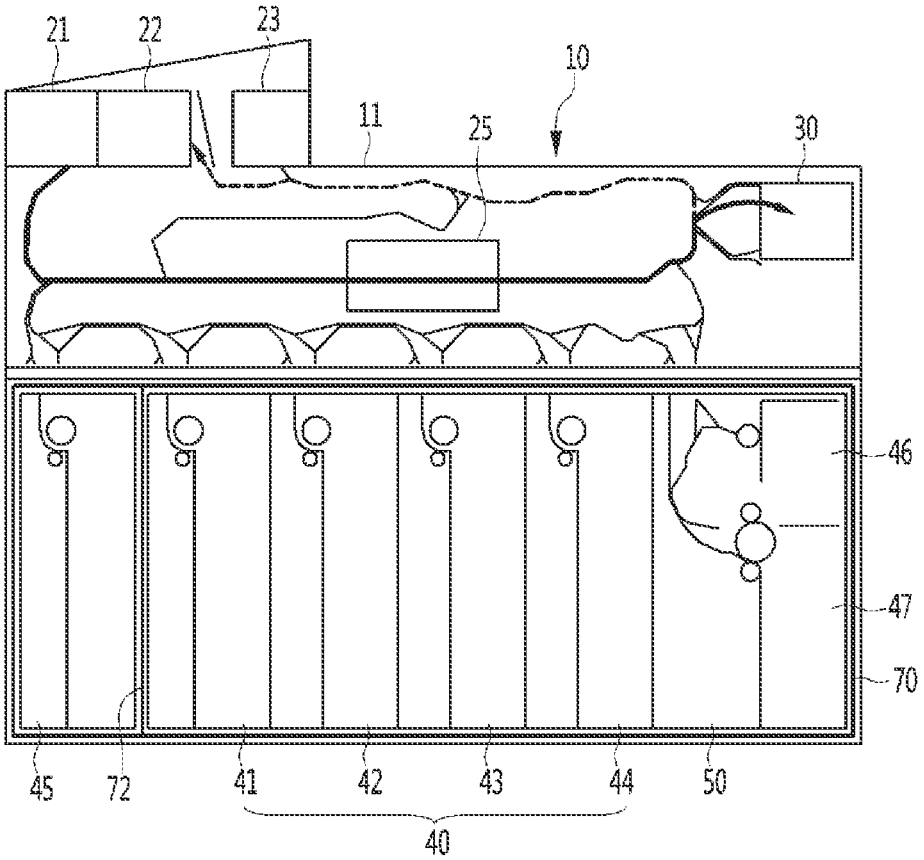
Figure 4:
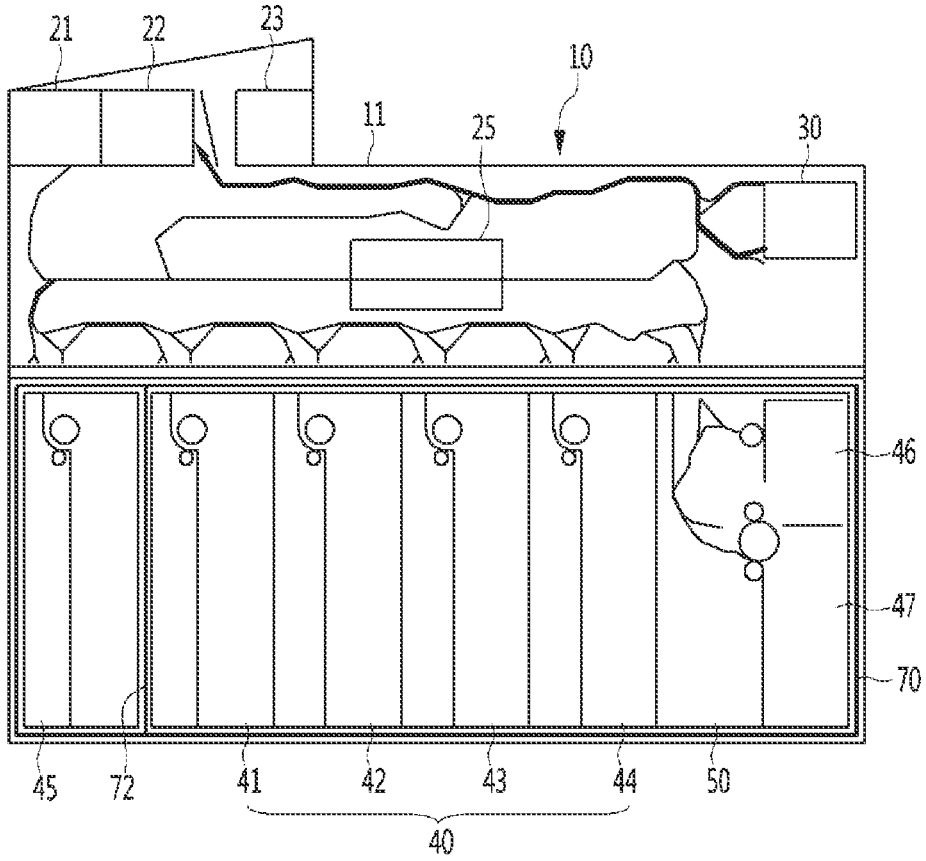
Figure 5:
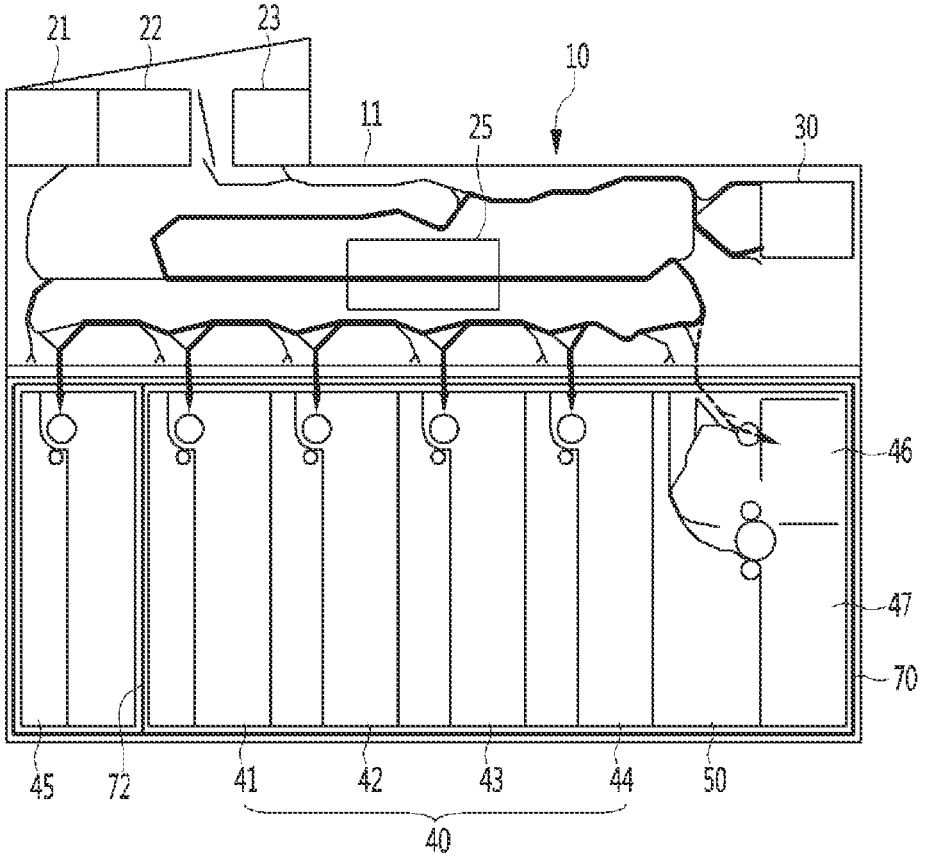

FIGS. 3 to 5 views illustrating transfer of the medium in the deposit process according to the first embodiment, wherein FIG. 3 is a view illustrating transfer of the medium in a first deposit process, FIG. 4 is a view illustrating transfer of the medium when a deposit cancel command is inputted, and FIG. 5 is a view illustrating transfer of the medium in a second deposit process.

In this specification, a process in which the media accepted into the medium depositing and withdrawing unit 21 are stacked in the temporary stacker 30 may be called a first deposit process, and a process in which the user interface 12 receives a deposition confirmation command to transfer the media stacked in the temporary stacker 30 to the medium storage unit 40 may be called a second deposit process. Thus, when the second deposit process is completed, it may be determined that deposit transaction of the medium is completed.

Referring to FIG. 3, to deposit a medium, the medium may be accepted into the deposit part 21. The medium accepted into the deposit part 21 may be separated from each other into each sheet of media by the separation part. The medium separated into each sheet of media passes through the discrimination unit 25.

The medium that is recognized as the normal medium by the discrimination unit 25 may be transferred to the temporary stacker 30. On the other hand, the medium that is recognized as the abnormal medium by the discrimination unit 25 may be transferred to the withdrawal part 22 or the reject part 23.

Then, the user interface 12 may receive the deposit confirmation command or a deposit cancel command.

Referring to FIG. 4, when the user interface 12 receives the deposit cancel command, the media stacked in the temporary stacker 30 may be discharged from the temporary stacker 30 and then transferred to the withdrawal part 22 or the reject part 23.

Here, if the medium that is recognized as the abnormal medium in the first deposit process is transferred to the withdrawal part 22, the media discharged from the temporary stacker 30 may be transferred to the withdrawal part 22. On the other hand, if the medium that is recognized as the abnormal medium in the first deposit process is transferred to the reject part 23, the media discharged from the temporary stacker 30 may be transferred to the reject part 23.

Referring to FIG. 5, when the user interface 12 receives the deposit confirmation command, the media stacked in the temporary stacker 30 may pass again through the discrimination unit 25 and then be transferred and stacked in the medium storage unit 40.

Here, when the medium passing again through the discrimination unit 25 is determined as the abnormal medium, the medium that is determined as the abnormal medium may be collected to the collection cassettes 46 and 57.

In the current embodiment, the additional function cassette 45 may serve as a cassette that is capable of stacking media to be deposited when the deposit transaction is performed.

In this case, at least a kind of medium of kinds of medium accepted through the deposit part 21 may be stacked in the addition function cassette 45 in the second deposit process.

The additional function cassette 45 may serve as the recycle cassette. In this specification, a cassette having only the stacking function without using the discharge function may be defined as a stacking cassette.

According to the current embodiment, even though the medium to be deposited is stacked in the additional function cassette 45, since the additional function cassette 45 is disposed in the safe, the security may be secured.

Also, in case where the additional function cassette 45 functions as the stacking cassette for stacking, kinds of media that are capable of being processed by the financial device 1 may increase, and also, the number of media that are capable of being stored in the financial device 1 may increase.

For example, a kind of media different from a kind of media that are capable of being stored in a plurality of medium cassettes 41 to 44 may be stored in the additional function cassette 45.

If each of the first and second cassettes 46 and 47 is used as the recycle cassette or the stacking cassette, the number of media that are capable of being processed by the financial device 1 may more increase.

For another example, one kind of media of kinds of media that are capable of being stored in a plurality of medium cassettes 41 to 44 may be stored in the additional function cassette 45. For example, if media are fully filled in at least one medium cassette 41 to 44, or the reference number or more of media are stacked, the media to be stored in the at least one medium cassette 41 to 44 may be stored in the additional function cassette 45.

Thus, according to the current embodiment, an operation rate of the financial deice may increase. That is, in case of a general financial device, if media is fully filled in at least one medium cassette, the financial device may be stopped in operation. Then, unless the user accesses to the medium cassette in which the media are fully filled to take the media out, the financial device may not operate. However, according to the current embodiment, even though at least one medium cassette is fully filled with media, media to be stored in the one medium cassette fully filled with the medium may be stored in the additional function cassette 45, and thus, the financial device may continuously operate without being stopped.

The media stored in the additional function cassette 45 may be replenished to the one medium cassette if the number of media stored in the one medium cassette is less than the predetermined number.

In addition, since it is unnecessary to access to the medium cassette fully filled with the media, thereby to take the media out, the security may be improved.

The function and use of the additional function cassette 45 may be preset before the financial transaction or changed while the financial transaction. For example, the additional function cassette 45 may be switched in use as the recycle cassette for storing two kinds of media while being used for the recycle cassette for storing one kind of media.

Alternatively, if the collection cassettes 46 and 47 are fully filled and thus not recover media any more, the additional function cassette 45 may function as the collection cassette.

Alternatively, each of the collection cassettes 46 and 47 may be used as the recycle cassette. In this case, the same kind or two kinds of media different from each other may be stacked in the collection cassettes 46 and 47. Also, the additional function cassette 45 may be used as the collection cassette.

When the additional function cassette 45 is used as the collection cassette, the user interface 12 may receive a command for transferring the medium collected from the additional function cassette 45 to the withdrawal part 22. In this case, the user may automatically take the additional function cassette 45 out of the financial device to improve user's convenience.

For another example, the additional function cassette 45 may be used as a temporary stacking cassette for temporarily stacking media. Here, the maximum number of media that are capable of being stacked in the additional function cassette 45 may be greater than that of media that are capable of being stacked in the temporary stacker 30.

If the user interface 12 does not receive the number of media to be deposited, the media accepted into the deposit part 21 may be stacked first in the temporary stacker 30. Then, the number of media stacked in the temporary stacker 30 reaches the maximum number, the rest media that are not stacked in the temporary stacker 30 among the accepted media may be temporarily stacked in the additional function cassette 45.

For another example, the user interface may receive the number of media to be deposited. Here, if the received number of media is greater than the maximum number of media that are capable of being stored in the temporary stacker 30, the whole media to be deposited, which are accepted into the deposit part 21 may be stacked in the additional function cassette 45.

When the user interface 12 receives the deposit confirmation command, the media temporarily stacked in the additional function cassette 45 may be transferred to the medium storage unit 40 after passing through the discrimination unit 25.

<Withdrawal Process>

Figure 6:
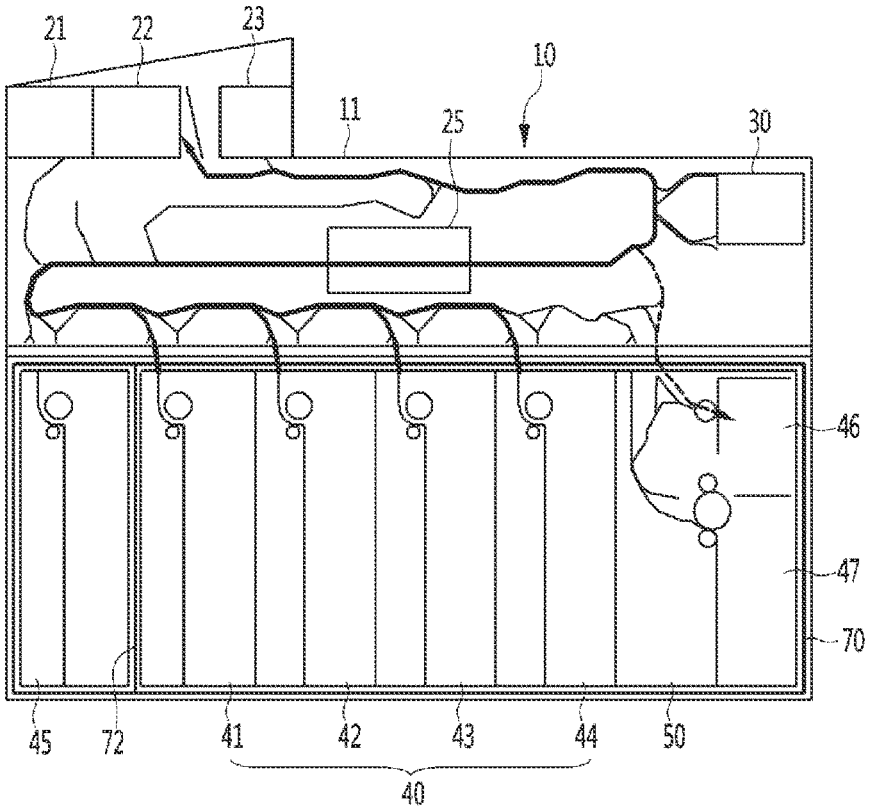
FIG. 6 is a view illustrating transfer of the medium in a withdrawal process according to the first embodiment.

FIG. 6 is a view illustrating transfer of the medium in the withdrawal process according to the first embodiment.

Referring to FIG. 6, when the user interface 12 receives the medium withdrawal command, a kind and the number of medium corresponding to the received sum of the medium to be withdrawn may be discharged from the medium storage unit 40. The media discharged from the medium storage unit 40 may pass through the discrimination unit 25. The medium that is determined as the normal medium among the media passing through the discrimination unit 25 may be transferred to the withdrawal part 22. On the other hand, the medium that is determined as the abnormal medium among the media passing through the discrimination unit 25 may be collected to the collection cassettes 46 and 47.

If the additional function cassette 45 functions as the recycle cassette, the medium stored in the additional function cassette 45 may be discharged and then transferred to the withdrawal part 22 in the withdrawal process.

Alternatively, when the media are fully filled into at least one medium cassette, and thus, the media that are not stored in the at least one medium cassette are stored in the additional function cassette 45, if the number of media stored in the at least one medium cassette is less than the predetermined number, the media stored in the additional function cassette 45 may be supplied to the at least one medium cassette. That is, the media stored in the additional function cassette 45 may pass through the discrimination unit 25 and then be replenished to the at least one medium cassette.

According to the current embodiment, if the number of media stored in the at least one medium cassette is less than the predetermined number, the media stored in the additional function cassette 45 may be used for the transaction to increase the operation rate of the financial device. In this case, it may be understood that the additional function cassette 45 functions as a replenishment cassette.

<Replenishment Process_Medium Replenishment Using Deposit Part>

Figure 7:
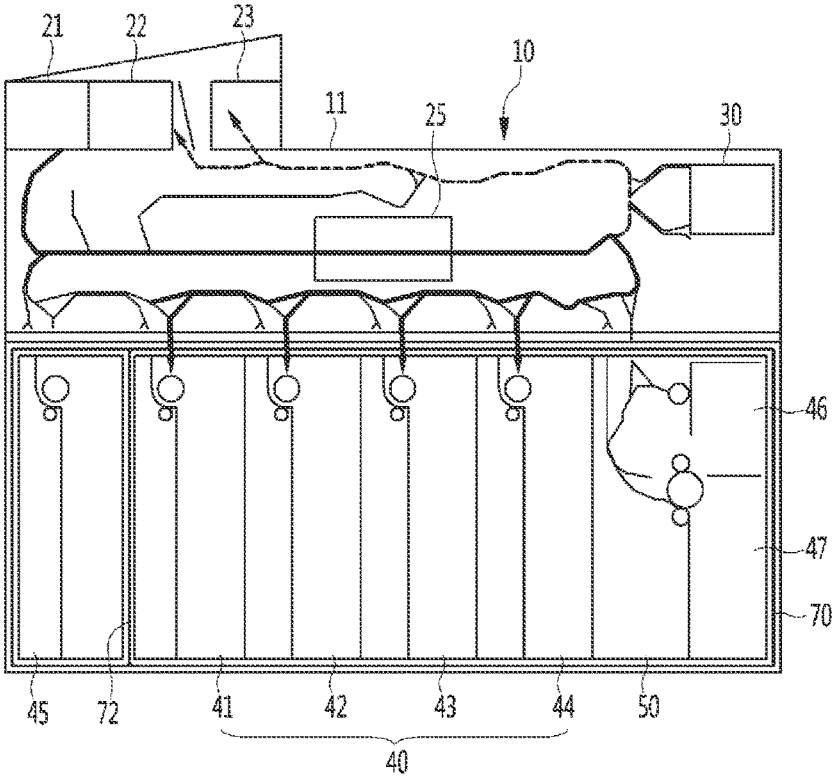
FIG. 7 is a view illustrating transfer of the medium in a medium replenishment process using a deposit part according to the first embodiment.

FIG. 7 is a view illustrating transfer of the medium in the medium replenishment process using the deposit part according to the first embodiment.

Referring to FIG. 7, the user may insert media to be replenished to the medium storage unit 40 into the deposit part 21. Here, a kind of media that are insertable into the deposit part 21 may be provided in at least one.

The medium to be replenished to the deposit part 21 passes through the discrimination unit 25.

The medium that is recognized as the normal medium by the discrimination unit 25 may be replenished to the medium storage unit 40 or the additional function cassette 45. Here, the medium to be replenished may not be stacked in the temporary stacker 30 after passing through the discrimination unit 25, but be replenished to the medium storage unit 40 or the additional function cassette 45.

On the other hand, the medium that is recognized as the abnormal medium by the discrimination unit 25 may be transferred to the withdrawal part 22 or the reject part 23.

The deposit process may be equally performed with the medium replenishment process using the deposit part according to transaction environments or areas.

That is, in the deposit process, the normal medium passing through the discrimination unit 25 may not be stacked in the temporary stacker 30, but be transferred to the medium storage unit 40 or the additional function cassette 45. The deposit process without performing the temporary stacking process may be called a quick deposit process.

The additional function cassette 45 may have a structure equal or similar to that of each of the plurality of medium cassettes. Thus, if the one medium cassette of the plurality of medium cassettes is not used due to breakdown, the one medium cassette may be replaced with the additional function cassette 45.

For example, a mounting part on which the plurality of medium cassettes are mounted is disposed in the safe. After the one medium cassette is separated from the mounting part, the additional function cassette may be mounted and used.

Thus, according to the current embodiment, the additional function cassette may be replaced with the one medium cassette without structurally changing the additional function cassette, and thus, the operation rate of the financial device may be improved.

<Replenishment Process_Medium Replenishment Using Additional Function Cassette>

FIG. 6 is a view illustrating transfer of the medium in the medium replenishment process using the additional function cassette according to the first embodiment.

Figure 8:
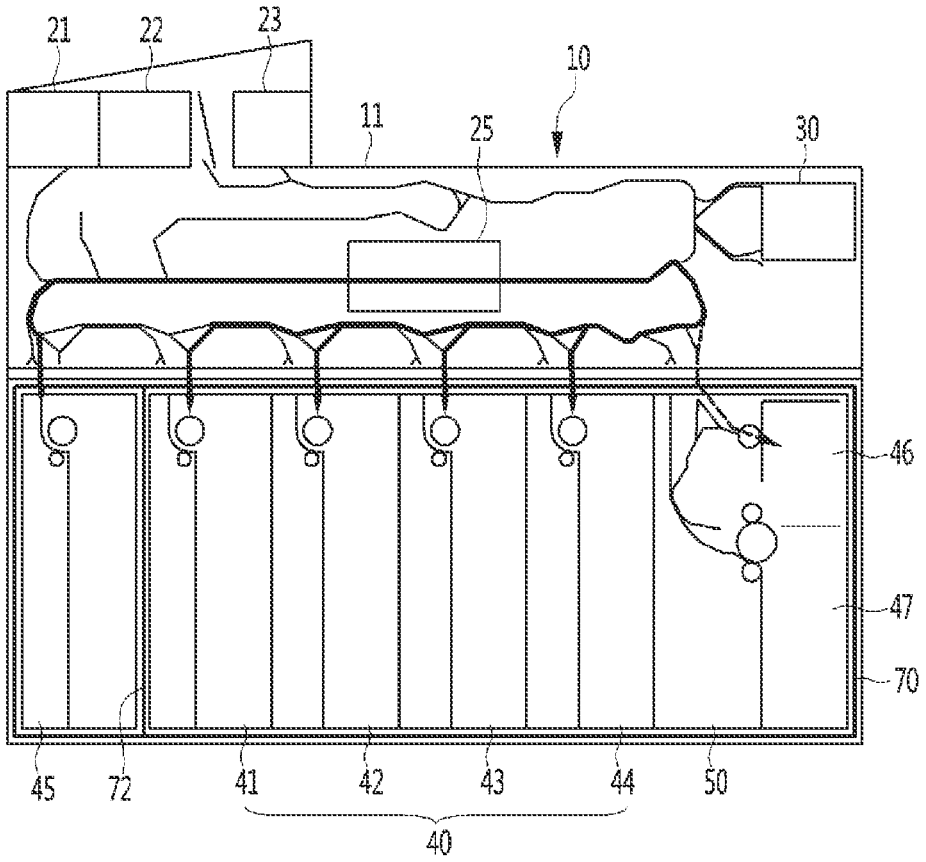
FIG. 8 is a view illustrating transfer of the medium in the medium replenishment process using an additional function cassette according to the first embodiment.

Referring to FIG. 8, the additional function cassette 45 may be used as the cassette for supplement.

The user having the authority that is accessible to the additional function cassette 45 may access to the additional function cassette 45 to insert media to be replenished into the additional function cassette 45. As described above, the user having the authority that is accessible to only the additional function cassette 45 may not access to the medium storage unit 40.

Also, a kind of media that are insertable into the additional function cassette 45 may be provided in at least one.

The user interface 12 may receive the replenishment command. When the replenishment command is received, the medium to be replenished may be discharged from the additional function cassette 45, and the discharged medium may pass through the discrimination unit 25.

The medium that is recognized as the normal medium by the discrimination unit 25 may be replenished to the medium storage unit 40. Here, a serial number of media to be replenished may be recognized by the discrimination unit 25, the recognized serial number of media may be stored in the memory 13. Thus, information of media replenished to at least one medium cassette of the medium storage unit 40 may be stored and managed in the memory 13.

On the other hand, the medium that is determined as the abnormal medium by the discrimination unit 25 may be collected to the collection cassettes 46 and 47.

According to the current embodiment, since the media are automatically replenished after the media are accepted once into the additional function cassette 45 disposed in the safe 70, the user's convenience may be improved.

Also, after the media are accepted once into the additional function cassette 45 disposed in the safe 70, the user may not be accessible to the additional function cassette 45 or the medium storage unit 40 in the medium replenishment process. Thus, the security of the financial device may be improved.

<Collection Process>

Figure 9:
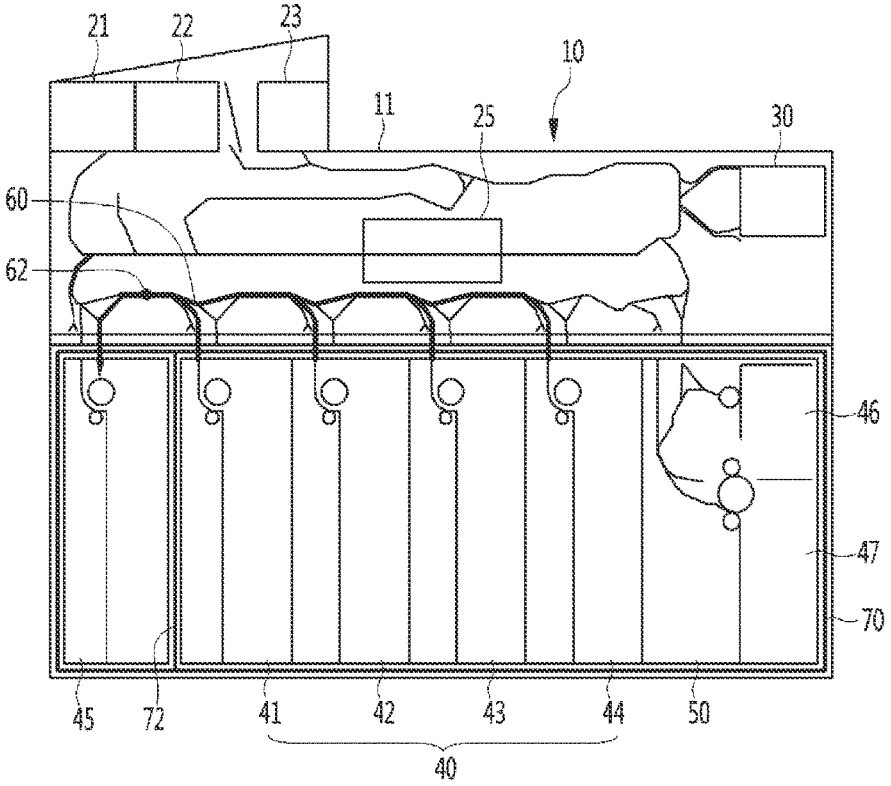
FIG. 9 is a view illustrating transfer of the medium in a medium collection process using the additional function cassette according to the first embodiment.

FIG. 9 is a view illustrating transfer of the medium in the medium collection process using the additional function cassette according to the first embodiment.

Referring to FIG. 9, the additional function cassette 45 may be used as the cassette for collection. Alternatively, the additional function cassette 45 may be used as a cassette for replenishment and collection.

The user interface 12 may receive the collection command. When the collection command is received, media may be discharged from at least one medium cassette of the plurality of medium cassettes 41 to 44. The media discharged from the at least one medium cassette may be collected to the additional function cassette 45 by the transfer path 60 connected to the additional function cassette 45.

In the collection process, the media for the collection, which are discharged from the at least one medium cassette may not pass through the discrimination unit 25, but be transferred to the additional function cassette 45. Here, the number of media collected to the additional function cassette 45 has to be managed.

Thus, a sensor 62 for sensing the number of transferred media may be disposed in the transfer path 60.

Thus, the number of media collected to the additional function cassette 45 may be calculated by the sensor 62, and the calculated number of media may be stored in the memory 13.

Also, the media for the collection, which are discharged from the at least one medium cassette may be collected to the additional function cassette 45 via a minimum transfer path to minimize an occurrence of jamming in the transfer process.

According to the current embodiment, since the additional function cassette 45 is disposed in the safe 70, the security of the collected media may be secured.

<Audit Process_Partial Audit>

Figure 10:
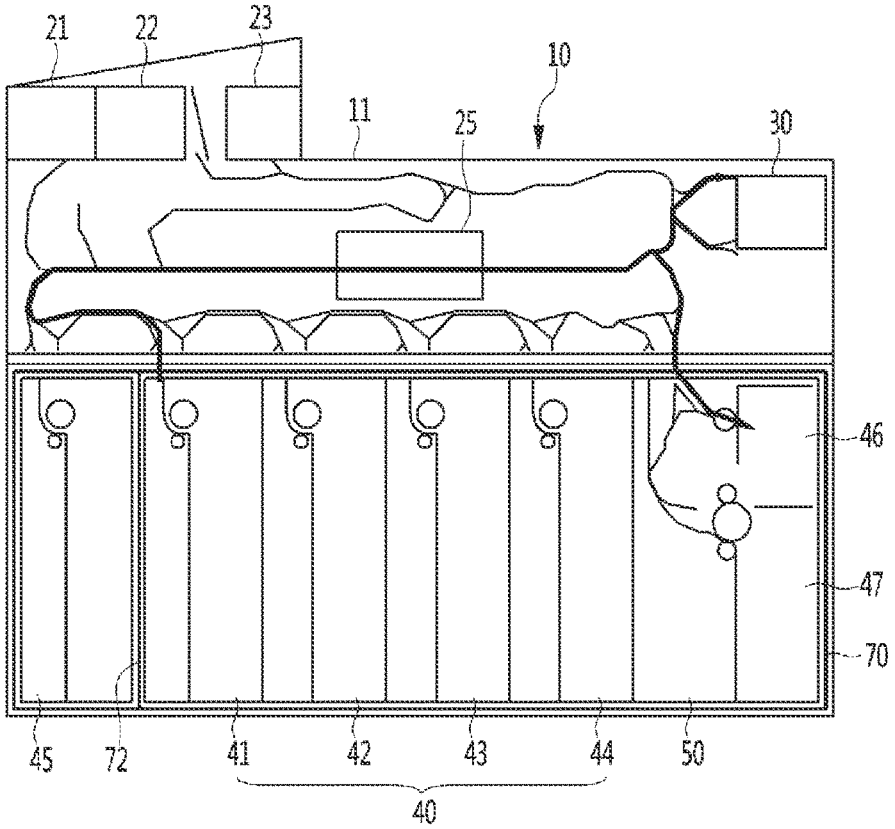
FIGS. 10 and 11 are views illustrating a process of performing audit by using a portion of media stored in the medium cassette according to the first embodiment.
Figure 11:
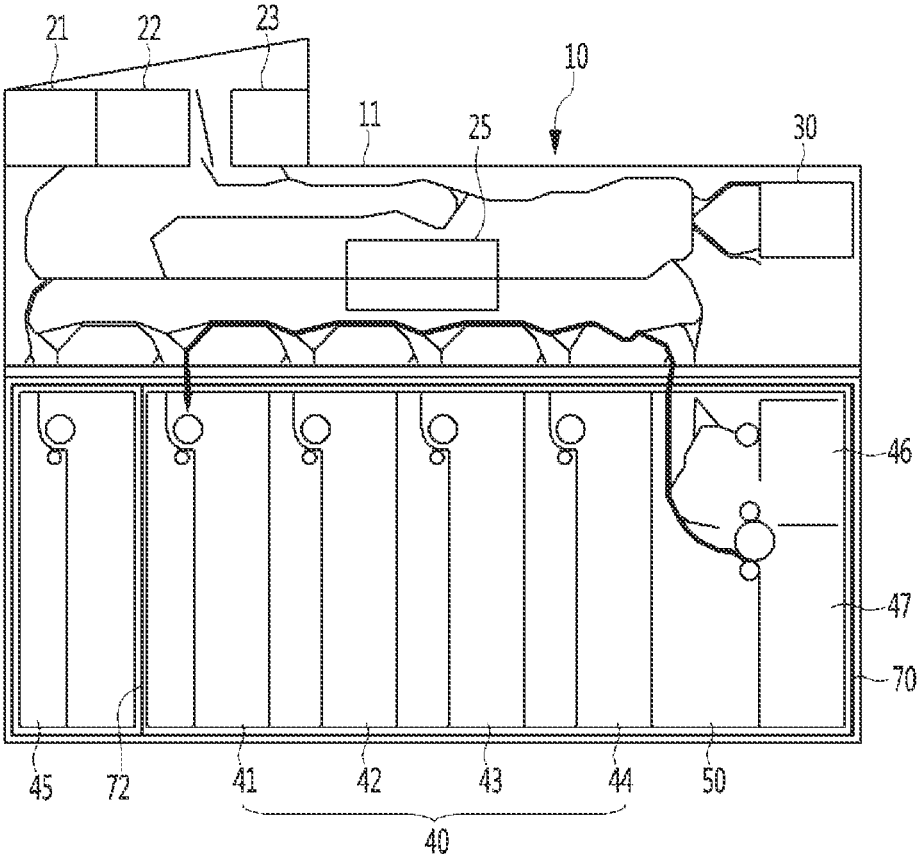

FIGS. 10 and 11 are views illustrating a process of performing audit by using a portion of media stored in the medium cassette according to the first embodiment.

Referring to FIGS. 10 and 11, when the today financial transaction is finished, when the today financial transaction starts, or when the user interface receives a partial audit command, media having a predetermined number may be discharged from the one medium cassette of the plurality of medium cassettes 41 to 45. In the current embodiment, the media having the predetermined number may be less than the maximum number of media that are capable of being stored in the one medium cassette. The media discharged from the one medium cassette may be transferred to the collection cassette 47 after passing through the discrimination unit 25.

While the media having the predetermined number passes through the discrimination unit 25, the discrimination unit 25 may recognize a serial number of each of the media having the predetermined number.

The control unit 14 may compare the serial number of each of the media having the predetermined number, which is recognized by the discrimination unit 25 with a serial number of media stored in the memory 13.

A serial number of media stored in each of the plurality of medium cassettes 41 to 45 is stored in the memory 13. When the serial number of each of the media having the predetermined number matches the serial number of media stored in the memory 13, the media having the predetermined number collected to the collection cassette 47 may be transferred again to the one medium cassette.

On the other hand, if the serial number of each of the media having the predetermined number does not match the serial number stored in the memory 13, the information of the serial number stored in the memory 13 may be corrected, and the corrected serial number may be stored.

Also, if at least one serial number of the serial numbers of the media having the predetermined number is not stored in the memory 13, or the serial numbers of media are stored to be inverted in order, the information stored in the memory 13 may be corrected of deleted to match the serial numbers of media stored in the actual media cassettes with the serial numbers of media, which are stored in the memory.

Alternatively, if the serial number of each of the media having the predetermined number does not match the serial number stored in the memory 13, the information of the serial number stored in the memory 13 may be deleted from the memory 13. In this case, since the media having the predetermined number are previously disposed in the collection cassettes 46 and 47, it is unnecessary to perform the process for recovering the media having the predetermined number.

According to the current embodiment, since the audit is performed by using the media having the predetermined number, the audit process may be simplified. Also, since the media having the predetermined number are not exposed to the outside, but is maintained in the state stored in the safe in the audit process, the user may not access to the media having the predetermined number to secure the security.

For another example, at least one medium cassette of the plurality of medium cassettes may further comprise a temporary stacking space for performing the temporary stacking function. For example, the temporary stacking space and the storing space for storing the media may be divided within the one medium cassette. In this case, the media having the predetermined number and to be audited may be transferred to the temporary stacking space, and then, when the audit is completed, the media may be transferred again to the one medium cassette.

For another example, at least one medium cassette of the plurality of medium cassettes may be a multi-stage cassette having a plurality of spaces. That is, a plurality of spaces may be independently defined in the medium cassette to store the media, and the media stored in each space may be separated by the separation part and discharged to the outside of the medium cassette.

In this case, the media having the predetermined number and to be audited may be transferred to one space of the multi-stage cassette, and then, when the audit is completed, the media may be transferred again to the one medium cassette.

When the audit of the media in the one medium cassette of the plurality of medium cassettes is completed, media in the next medium cassette may be audited.

For another example, the media having the predetermined number, which are discharged from the medium cassette may be transferred to the medium cassette without passing through other modules after passing through the discrimination unit.

For another example, the media having the predetermined number, which are discharged from the medium cassette may be transferred to the additional function cassette, and the media transferred to the additional function cassette may be transferred again to the medium cassette after passing through the discrimination unit.

Alternatively, although the audit is performed by using the media having the predetermined number, if additional audit is required, more media than the media having the predetermined number may be discharged from the medium cassette and transferred to the additional function cassette, and then the media transferred to the additional function cassette may be transferred again to the medium cassette after passing through the discrimination unit.

<Audit Process_Whole Audit>

Figure 12:
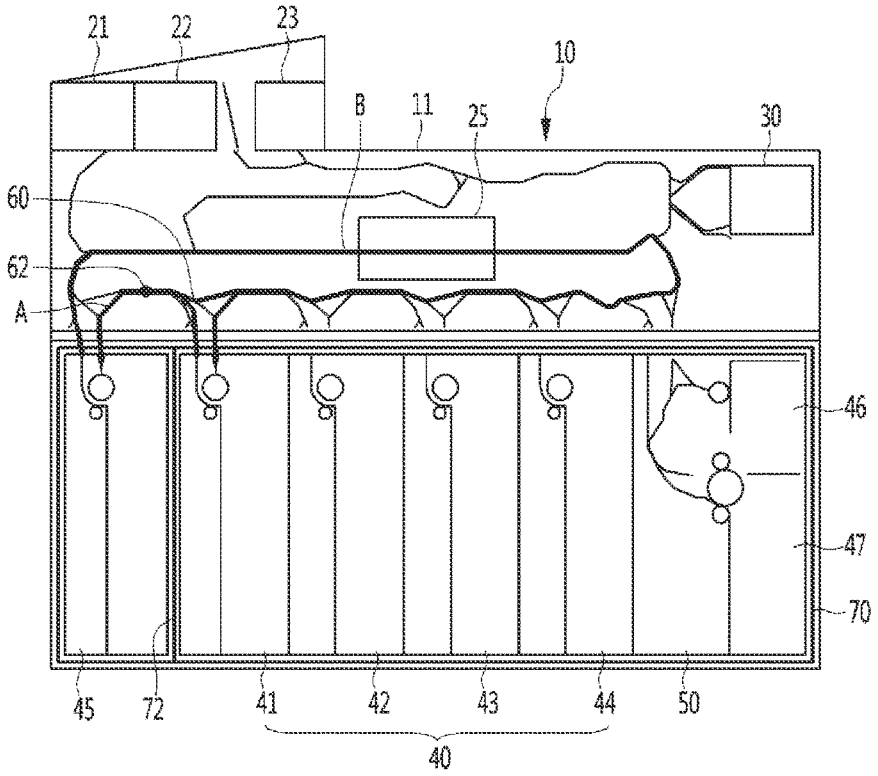
FIG. 12 is a view illustrating a process of performing audit by using the whole media stored in the medium cassette according to the first embodiment.

FIG. 12 is a view illustrating a process of performing audit by using the whole media stored in the medium cassette according to the first embodiment.

Referring to FIG. 12, when the today financial transaction is finished, when the today financial transaction starts, or when the user interface receives a partial audit command, the whole media stored in the one medium cassette of the plurality of medium cassettes 41 to 45 may be discharged. The media discharged from the one medium cassette may be transferred to the additional function cassette 45 without passing through the discrimination unit 25 (see an arrow A). In this case, the additional function cassette 45 may be used as the cassette for the audit.

The media transferred to the additional function cassette 45 may pass through the discrimination unit 25 after being discharged from the additional function cassette 45 and then be transferred again to the one medium cassette (see an arrow B).

Here, an order of the media stacked in the one medium cassette may be inverted while being transferred to the additional function cassette 45. However, when the media discharged from the additional function cassette 45 return to the one medium cassette, the order of the media may be inverted to return to its original order.

The discrimination unit 25 may recognize the serial number of each of media stored in the one medium cassette. The recognized serial number may be stored in a memory 13.

Alternatively, if the serial number of each of media, which is discriminated by the discrimination unit 25 does not match the serial number of each of media stored in the memory 13, the information of the serial number stored in the memory 13 may be corrected.

According to the current embodiment, since the audit is performed by using the whole media stored in the one medium cassette, the accurate audit may be enabled. Also, since the media are not exposed to the outside, but are maintained in the state stored in the safe in the audit process, the security may be secured in the audit process.

When the audit of the media in the one medium cassette of the plurality of medium cassettes is completed, media in the next medium cassette may be audited.

Figure 13:
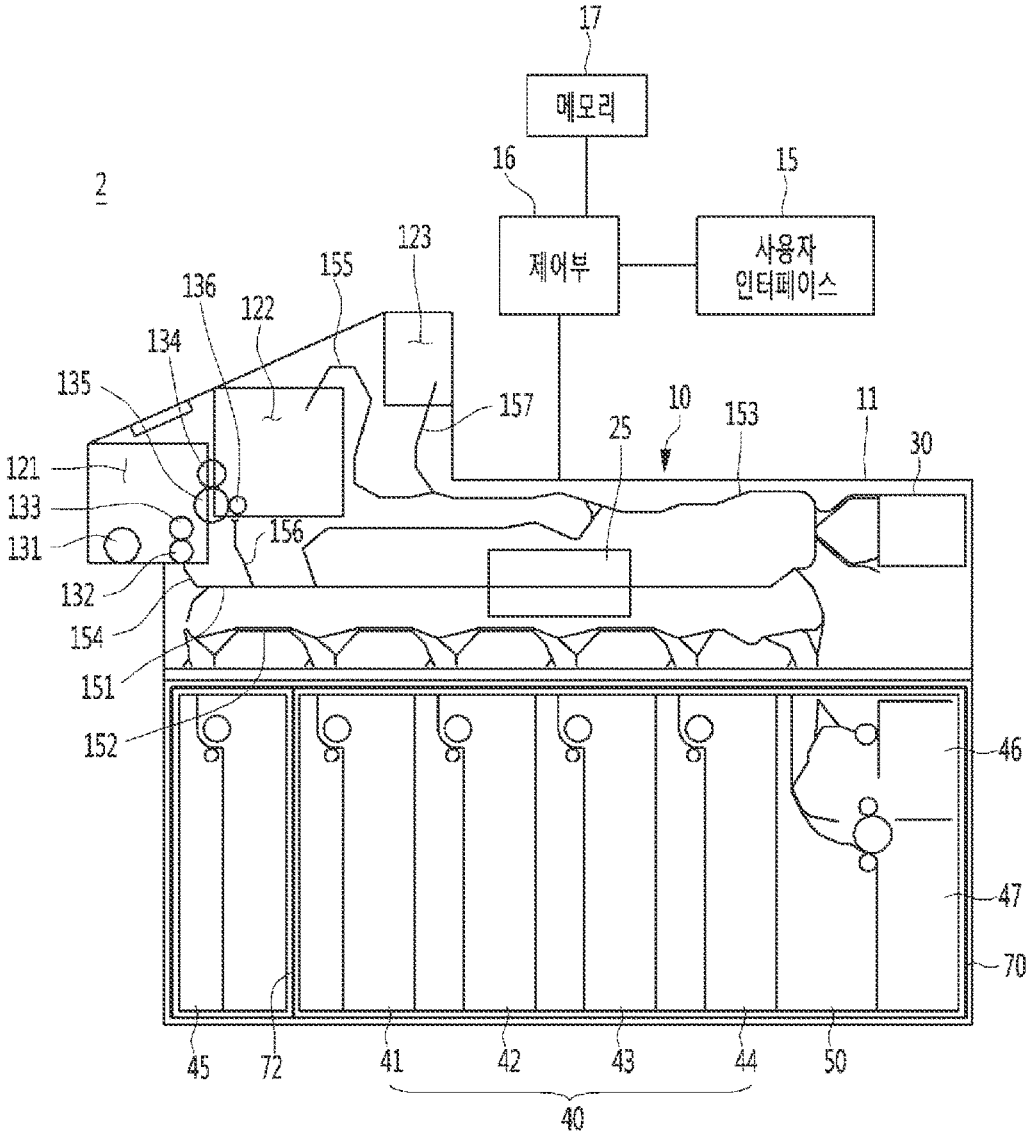
FIG. 13 is a schematic view of a financial device according to a second embodiment.
Figure 14:
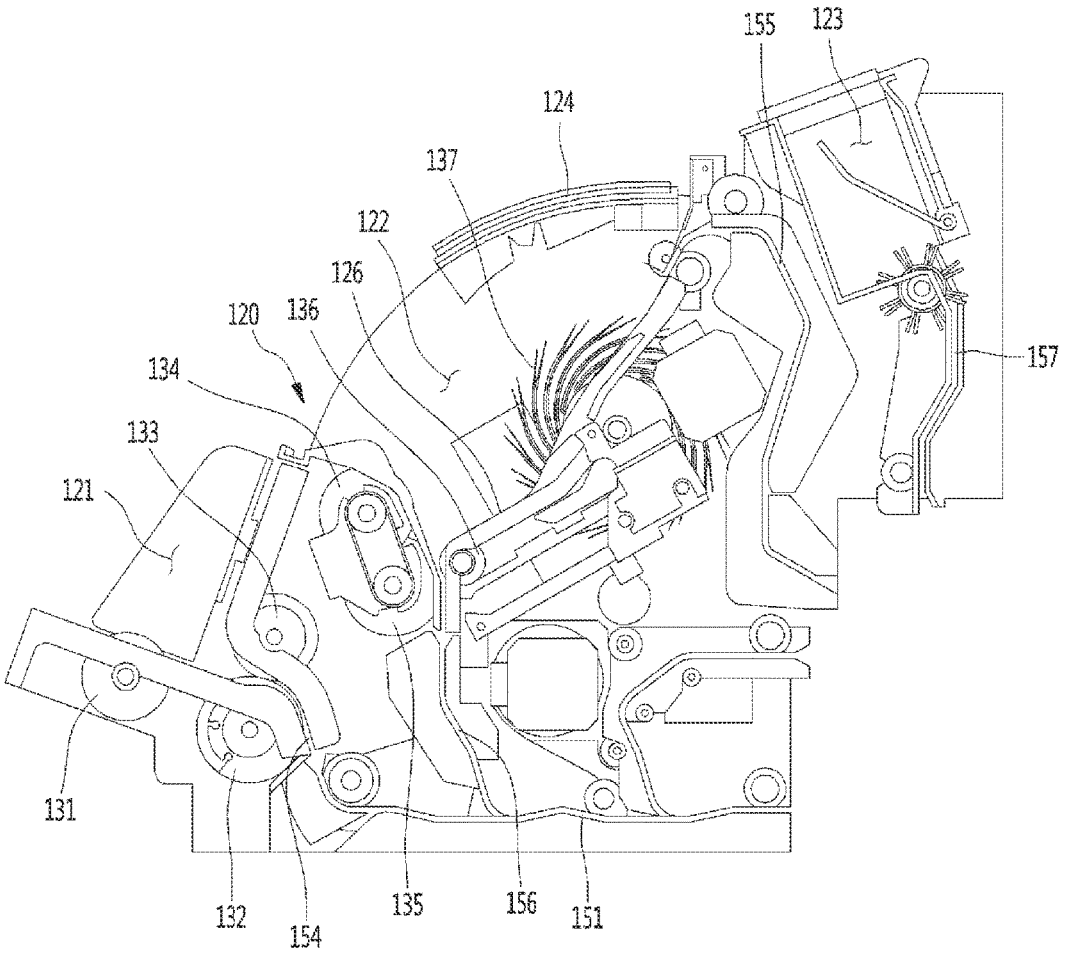
FIG. 14 is a schematic view of a medium depositing and withdrawing unit according to a second embodiment.

FIG. 13 is a schematic view of a financial device according to a second embodiment, and FIG. 14 is a schematic view of a medium depositing and withdrawing unit according to a second embodiment.

Referring to FIGS. 13 and 14, a financial device 2 according to a second embodiment may comprise a medium processing apparatus 10. The medium processing apparatus 10 may be disposed in a cabinet 11.

The financial device 2 may further comprise a control unit 16, an user interface, and a memory 17. In the current embodiment, descriptions with respect to the control unit 16, the user interface 15, and the memory 17 may be cited from those of the first embodiment, and thus their detailed descriptions will be omitted.

The medium processing apparatus 10 may comprise a medium depositing and withdrawing unit 120 through which the user takes a medium in or out.

The medium processing apparatus 10 may further comprise a discrimination unit 25 for discriminating a medium to be deposited, a medium to be withdrawn, or a medium to be counted.

Also, the medium processing apparatus 10 may further comprise a temporary stacker 30 for temporarily stacking media. However, the temporary stacker 30 may be omitted according to used areas or positions of the financial device 1.

The medium processing apparatus 10 may further comprise a medium storage unit 40 for storing a medium, an additional function cassette 45, a transfer module 50, and collection cassettes 46 and 47. Also, the medium storage unit 40, the additional function cassette 45, the transfer module 50, and the collection cassettes 46 and 47 may be disposed in a safe 70.

Since the medium storage unit 40, the additional function cassette 45, the transfer module 50, and the collection cassettes 46 and 47 have the same structure and function as those of the first embodiment, their duplicated descriptions will be omitted, and only specific portions will be described. For example, the various usages and functions of the additional function cassette described in the first embodiment may be equally applied to the current embodiment.

The medium depositing and withdrawing unit 120 may provide an entrance through which a medium to be deposited, a medium to be withdrawn, and a medium to be counted are accepted or withdrawn.

The medium depositing and withdrawing unit 120 may comprise a first space 121 and a second space 122. The medium to be deposited or the medium to be counted may be accepted into the first space 121. The counted medium, a medium passing through a discrimination unit 25 among media to be deposited, or the medium to be withdrawn may be stacked in the second space 122.

The medium depositing and withdrawing unit 120 may comprise a first separation part for separating the medium disposed in the first space 121.

The first separation part may comprise a first pick-up roller for picking the media disposed in the first space 121 up, a first feed roller 132 for separating the media picked up by the first pick-up roller 131 into each sheet of media, and a first gate roller 133. The first gate roller 133 may be maintained in a state in which the first gate roller 133 rotates in a direction opposite to the first feed roller 132 or is stopped.

The medium depositing and withdrawing unit 120 may further comprise a stack guide 137 for guiding stacking of media accepted into the second space 122 and a second separation part for separating media in the second space 122 to deposit the media accepted into the second space 122.

The second separation part may comprise a second pick-up roller for picking the media disposed in the second space 122 up, a second feed roller 135 for separating the media picked up by the second pick-up roller 135 into each sheet of media, and a second gate roller 136. The second gate roller 136 may be maintained in a state in which the second gate roller 136 rotates in a direction opposite to the second feed roller 135 or is stopped.

The stack guide 137 may guide the media accepted into the second space 122 so that the media are stacked one by one on a support surface 126. For example, the stack guide 137 may be a stack wheel for guiding the media accepted by rotation thereof to the support surface 126.

The second space 122 may be opened and closed by a shutter 124.

The shutter 124 may open the second space 122 in the counting process or close the second space 122 in the counting process. When the counting process is completed, the shutter 124 may open the second space 122. Also, the shutter 124 may open or close the second space 122 in the deposit process.

FIG. 14 illustrates a state in which the shutter 124 opens the second space 122. In this state, when the shutter 124 moves to a left upper side in the drawing, the second space 122 may be closed.

The medium depositing and withdrawing unit 120 may further comprise a third space 123 for storing a medium that is not recognized by the discrimination unit 25 or determined as a faulty medium in the counting process and/or deposit process.

The third space 123 may be opened and closed by a shutter (not shown). Alternatively, a cover member for covering a portion of an opening of the third space 123 may be provided to prevent the transferred medium from being separated.

The first space 121, the second space 122, and the third space 123 may be spaces that are independent with respect to each other. Alternatively, at least a space may be a space that is defined by dividing one independent space by using a division member such as a partition or guide. Here, when at least a portion of the first, second, and third spaces 121, 122, and 123 may be divided, the space may vary in volume by movement of the division member.

At least a portion of the second space 122 may be defined at a height higher than that of the first space 121. Also, at least a portion of the third space 123 may be defined at a height higher than that of the second space 122. That is, the first to third spaces 121 to 123 may be defined at heights different from each other. Thus, a user may easily access to the first to third spaces 121 to 123.

One point of the first space 121, one point of the second space 122, and one point of the third space 123 may be disposed in one line. Here, the line may be inclined at a predetermined angle with respect to a horizontal line. As described above, due to the arrangement of the first to third spaces 121 to 123, user's moving line may be shorter and convenient.

For example, since the user takes the medium staked in the third space 123 defined at a height higher than that of the first space 121 out of the third space 123 and then inserts the medium into the first space 121 while lower user's hand, the user's convenience may be maximized.

Although not limited, the user interface 15 may be disposed in an upper portion of the third space 123. In this case, in the state in which the user inserts the medium into the first space 121, the user interface 15 may be manipulated without interference.

The financial device 2 may further comprise a transfer path for transferring the medium.

The transfer path may further comprise a first transfer path 151 passing through the discrimination unit 25, a second transfer path 152 connected to the first transfer path 151, and a third transfer path 153. Although not limited, the second transfer path 152 may be disposed above the first transfer path 151, and the third transfer path 153 may be disposed above the first transfer path 151.

Also, the transfer path may further comprise a connection path 154 connecting the first space 121 to the first transfer path 151. The medium in the first space 121 may be transferred to the first transfer path 151 through the connection path 154.

The transfer path may further comprise an entrance path 155 that is branched from the third transfer path 153 to guide the medium in the third transfer path 153 to the second space 122 and a withdrawal path 156 for guiding the medium in the second space 122 to the first transfer path 151.

A medium to be counted or a medium to be deposited may be transferred along the third transfer path 153 after passing through the discrimination unit 25 and then be accepted from the third transfer path 153 into the second space 122 through the entrance path 155.

The transfer path may further comprise a collection path 157 that is branched from the third transfer path 153 to guide the medium in the third transfer path 153.

Here, since the medium is guided to the same path and the same space in the counting process and the deposit process, even though a command for the counting and a command for the deposit are separately received from the user through the user interface 15, the counting and deposit commands may be processed through the same control command in the financial device to simplify the control of the financial device.

Hereinafter, an operation of the financial device in the financial transaction will be described.

<Counting Process/First Deposit Process>

Figure 15:
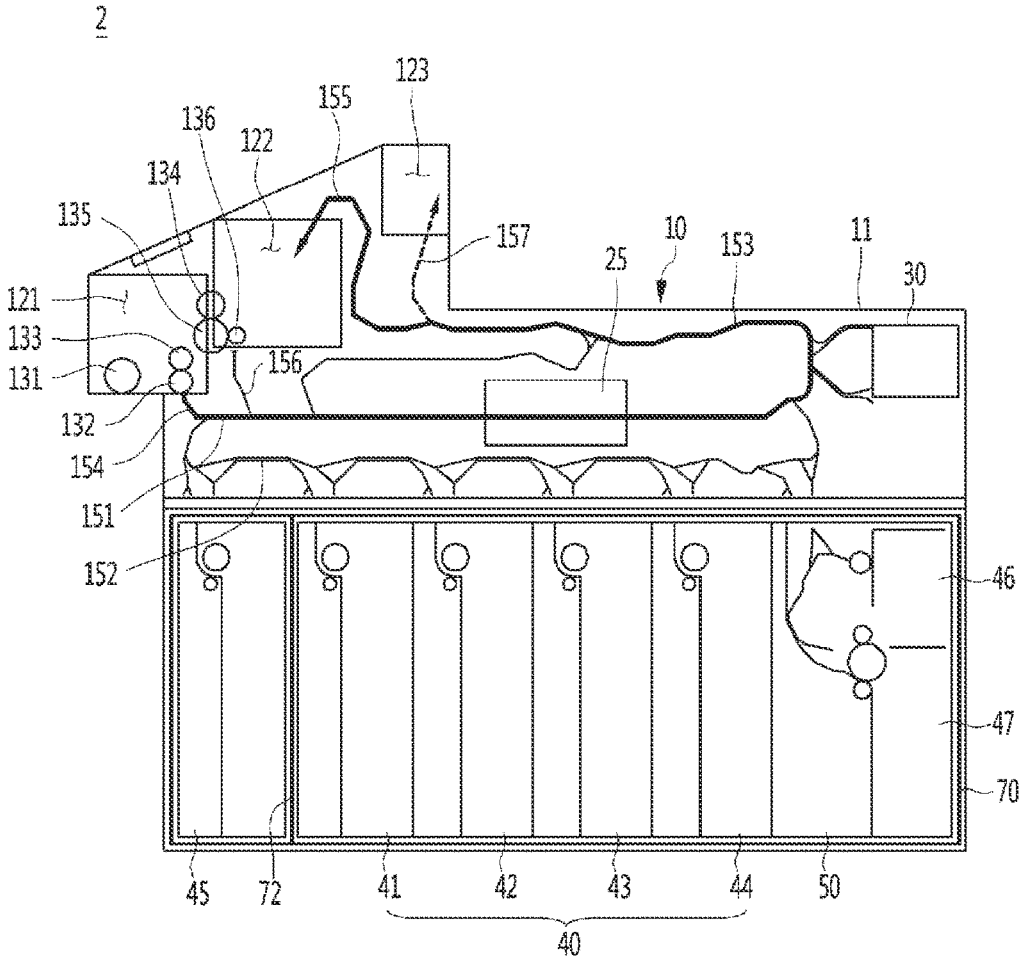
FIG. 15 is a view illustrating transfer of a medium in a counting process or a first deposit process according to the second embodiment.
Figure 16:
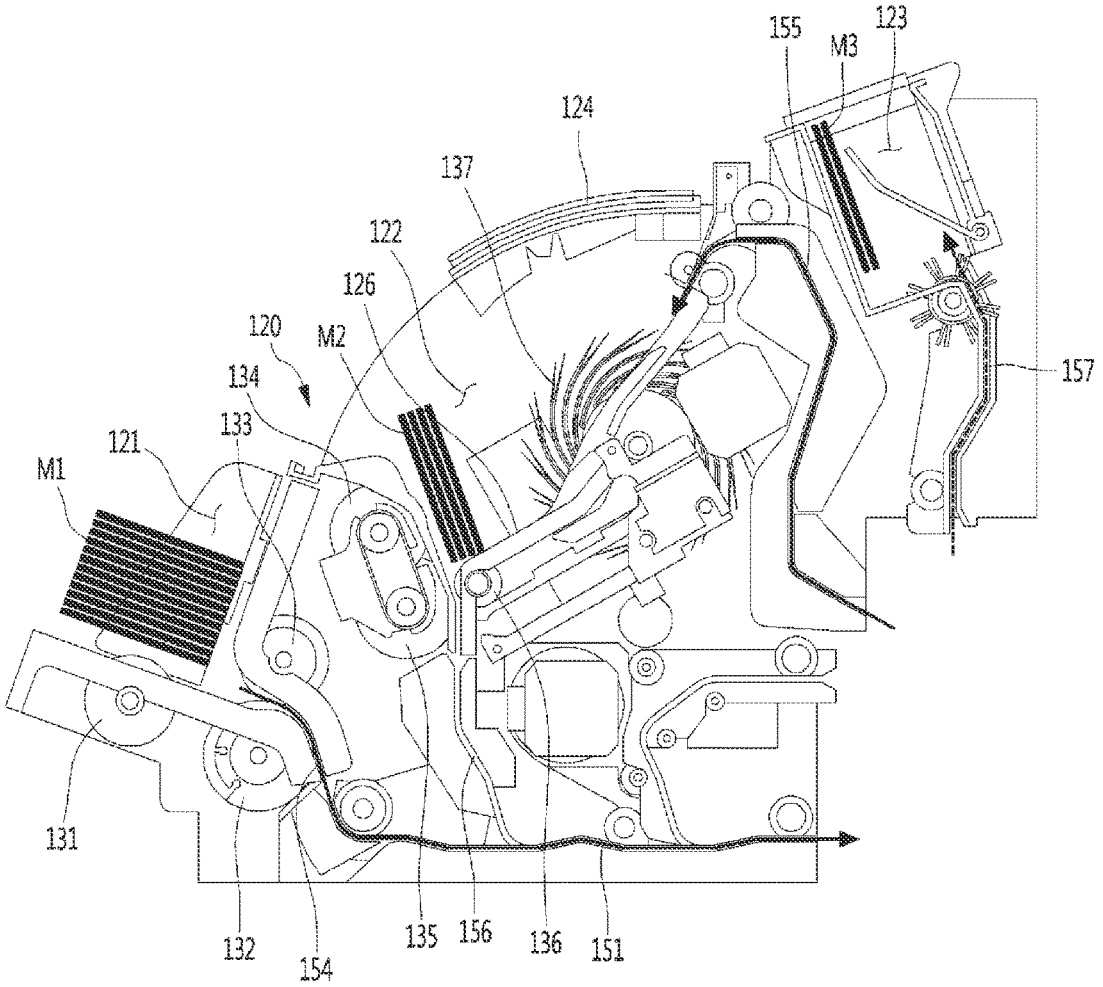
FIG. 16 is a view illustrating an operation of the medium depositing and withdrawing unit in the counting process or the first deposit process of FIG. 14.
Figure 17:
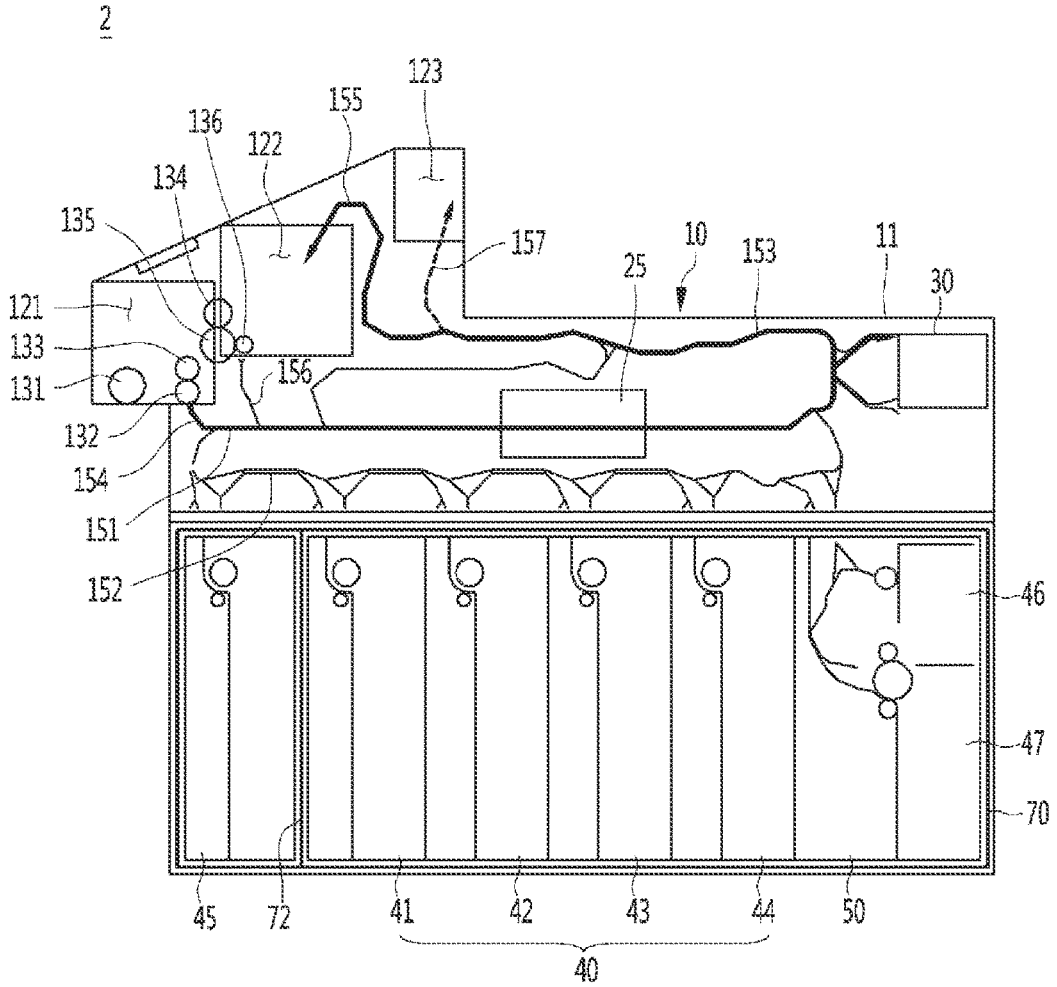
FIG. 17 is a view illustrating transfer of the medium when more media than media that are capable of being processed in a second space according to the second embodiment.

FIG. 15 is a view illustrating transfer of a medium in the counting process or the first deposit process according to the second embodiment, FIG. 16 is a view illustrating an operation of the medium depositing and withdrawing unit in the counting process or the first deposit process of FIG. 14, and FIG. 17 is a view illustrating transfer of the medium when more media than media that are capable of being processed in the second space according to the second embodiment.

Referring to FIGS. 15 and 16, in the first deposit process or the counting process, a medium M1 to be deposited and/or counted may be accepted into the first space 121.

The medium M1 accepted into the first space 121 may be separated from each other into each sheet of media. The medium M1 separated into each sheet of media may be transferred to the first transfer path 151 via the connection path 154. The medium M1 transferred to the first transfer path 151 may pass through the discrimination module 25.

A medium M2 that is recognized as a normal medium by the discrimination unit 25 may be accepted into the second space 122 through the entrance path 155 while being transferred along the third transfer path 153. The medium M2 accepted into the second space 122 may be seated on the support surface 126 by the stack guide 137.

On the other hand, a medium M3 that is determined as an abnormal medium by the discrimination unit 25 may be transferred to the third space 123 through the collection path 157 while being transferred along the third transfer path 153.

If the counting process is performed, information of the counted media stacked in the second space 122 and information of the media transferred to the third space 123 may be displayed on the user interface 15. Also, if the counted media are not deposited, the medium M2 stacked in the second space 122 may be taken out of the second space 122.

Here, in the counting process, the shutter 124 may be maintained in the state in which the shutter 124 opens or closes the second space 122. If the shutter 124 closes the second space 122, when the counting process is completed, the shutter 124 may automatically open the second space 122. Alternatively, if the shutter 124 closes the second space 122, when a shutter open command or a counting ending command is received through the user interface 15 after the counting process is completed, the shutter 124 may automatically open the second space 122.

Alternatively, if the shutter 124 closes the second space 122, when the counting process is completed, the shutter 124 may move to open the second space 122.

Alternatively, the third space 123 may be automatically or manually opened or closed by the shutter. After the counting process is completed, the user may take the medium M3 out of the second space 122 and/or the third space 123.

Also, if the second space 122 and the third space 123 are independently provided, shutters may be respectively provided in the spaces. If the second and third spaces 122 and 123 are divided by the division member, the second and third spaces 122 and 123 may be opened and closed by using one shutter.

Here, a shutter locking part (not shown) for maintaining the closed state of the shutter in the counting process to prevent the shutter from being opened may be further provided to allow the shutter to be locked. When the counting process is ended, the locking of the shutter locking part (not shown) may be released to automatically or manually open the shutter.

On the other hand, if the first deposit process is performed, information of the discriminated media stacked in the second space 122 and information of the media transferred to the third space 123 may be displayed on the user interface 15. Also, a deposit confirmation command or deposit cancel command with respect to the medium stacked in the second space 122 may be received through the user interface 15.

If the deposit confirmation command is received through the user interface 15, the medium M2 stacked in second space 122 may be separated by a second separation part and then transferred and deposited. The deposit process of the medium M2 in the second space 122 will be described below with reference to the accompanying drawings.

On the other hand, when a deposit cancel command is received, the deposit process may be ended, and the user may take the medium M2 stacked in the second space 122 out of the second space 122. Here, the shutter 124 may be maintained in the state in which the shutter 124 closes the second space 122 in the deposit process. When the deposit cancel command is received, the shutter 124 may automatically or manually open the second space 122.

According to the current embodiment, when the deposit cancel command is received, the medium stacked in the second space 122 may be taken just out. Thus, the transfer process for transferring the medium stacked in the temporary stacker according to the related art into the space for the withdrawal may be omitted to reduce the transaction time and prevent the jamming due to the transfer of the medium from occurring.

Also, the shutter 124 may be formed of a transparent or translucent material. In this case, the customer may confirm the medium stacked in the second space 122. When the deposit is canceled, the customer may directly confirm a process of withdrawing the medium from the second space 122 to improve reliability for the customer.

Also, a shutter locking part (not shown) for maintaining the closed state of the shutter in the deposit process to prevent the shutter from being opened may be further provided to allow the shutter to be locked. When the deposit process is ended, or the deposit cancel command is received, the locking of the shutter locking part (not shown) may be released to automatically or manually open the shutter.

In the deposit process, the second space 122 may serve as a temporary stacking space in which the medium is temporarily stacked. Also, when the deposit cancel command is received, the second space 122 may serve as a withdrawal space from which the stacked medium is withdrawn by the user when the deposit is canceled.

Referring to FIG. 17, more media than the maximum number of media that are capable of being stacked in the second space 122 may be accepted into the first space 121.

In this case, the medium separated from the first space 121 to pass through the discrimination unit 25 may be stacked in the second space 122. Also, the media stacked in the second space 122 reaches the maximum number, the medium separated from the first space 121 to pass through the discrimination unit 25 may be stacked in the temporary stacker 30.

According to the current embodiment, since the number of media that are capable of being temporarily stacked when the transaction is performed once increases, a deposit transaction number may be reduced, and thus, a transaction time taken to deposit the whole media may be reduced.

If the media are stacked in only the temporary stacker, when it is intended to deposit media, which are capable of being stacked in the temporary stacker, exceeding the maximum number, the deposit transaction has to be performed at least two times. According to the current embodiment, the deposit transaction may be performed once to deposit the media.

Also, since the media are temporarily stacked in the second space and the temporary stacker, respectively, a portion of the medium cassettes within the safe may not be used as the temporary stacker. Thus, kinds of transacting media may be prevented from being reduced, or the number of transacting media may be prevented from being reduced.

In the deposit process, the deposit cancel command may be received. In this case, the media stacked in the temporary stacker may return to the customer. The medium stacked in the medium cassette within the safe is not costumer's money. However, if the medium cassette within the safe is used as the temporary stacker, money previously stored in the medium cassette and customer's money may be mixed with each other. Thus, when the medium is discharged from the temporary stacker, the money that is not the customer's money may be discharged.

In the current embodiment, the temporary stacker 30 may be disposed outside the safe 70. Thus, the mixing of the customer's money in the temporary stacker 30 and the money that is not the customer's money may be prevented.

For another example, when the media are temporarily stacked in the temporary stacker, and the number of media stacked in the temporary stacker reaches a predetermined number in the first deposit process, the media separated from the first space 121 to pass through the discrimination unit 25 may be temporarily stacked in the second space 122.

For another example, when media are temporarily stacked first in one of the second space 122 and the temporary stacker 30, and the media are not temporarily stacked in one of the second space 122 and the temporary stacker 30 in the first deposit process, for example, when it is not intended to stack the media due to stack impediment such as faulty stacking even though the media are not fully filled in the second space or the temporary stacker, the media may be temporarily stacked in the other one of the second space 122 and the temporary stacker 30.

For another example, the additional function cassette 45 may be used as the temporary stacking cassette for temporarily stacking media. Here, the maximum number of media that are capable of being stacked in the additional function cassette 45 may be greater than that of media that are capable of being stacked in each of the second space 122 and the temporary stacker 30.

When the number of media to be deposited is not inputted to the user interface 12, the media accepted into the first space 121 may be stacked first in one of the temporary stacker 30 and the second space 122.

If media are fully filled into the temporary stacker 30 and the second space 122 and thus are not stacked any more, the media may be temporarily stacked in the additional function cassette 45.

That is, a transfer position of the media that pass through the discrimination unit 25 and are temporarily stacked may be determined to one of the second space 122, the temporary stacker 30, and the additional function cassette 45 according to the number of media passing through the discrimination unit 25, and then the media may be transferred to the determined position.

For another example, the maximum number of media that are capable of being stacked in the additional function cassette 45 may be greater than the sum of the maximum number of media that are capable of being stacked in each of the second space 122 and the temporary stacker 30.

In this specification, it is assumed that the maximum numbers of media that are capable of being stacked in the second space 122 and the temporary stacker 30 are the same.

The user interface may receive the number of media to be deposited. Here, if the received number of media is less than the maximum number of media that are capable of being stored in the temporary stacker 30 or the second space 122, the media may be temporarily stacked in one of the temporary stacker 30 and the second space 122.

If the received number of media is greater than the maximum number of media that are capable of being stored in one of the temporary stacker 30 and the second space 122 and is less than the sum of the maximum numbers that are capable of being respectively stored in the temporary stacker 30 and the second space 122, the media may be divided to be stacked in the temporary stacker 30 and the second space 122.

If the received number of media is greater than the sum of the maximum numbers of media that are capable of being respectively stored in the temporary stacker 30 and the second space 122, the whole media to be deposited may be temporarily stacked in the additional function cassette 45.

When the user interface 12 receives the deposit confirmation command, the media temporarily stacked in the additional function cassette 45 may be transferred to the medium storage unit 40 after passing through the discrimination unit 25.

For another example, kinds of media are classified and then temporarily stacked in the second space 122 and the temporary stacker 30. For example, at least a kind of media may be temporarily stacked in the temporary stacker 30, and a kind of media different from the kind of media that are capable of being stacked in the temporary stacker 30 may be temporarily stacked in the second space 122.

For example, a kind of frequently transacting media may be temporarily stacked in the temporary stacker 30.

Although the user intends to deposit only one kind of media (first kind of media), if two kinds of media (first kind of media and second kind of media) are unintentionally inserted through the first space 121, the first kind of media may be temporarily stacked in the temporary stacker 30, and the second kind of media may be temporarily stacked in the second space 122.

The user may determine whether the second kind of media is deposited. When the user interface 15 receives a deposit cancel command with respect to the second kind of media, the shutter 124 of the second space 122 may be opened just, and the user may take the second kind of media out of the second space 122. On the other hand, the media temporarily stacked in the temporary stacker 30 may be secondarily deposited.

Alternatively, when the user interface 15 receives the deposit confirmation command with respect to the first and second kinds of media, each of the kinds of media may be transferred to the medium storage unit 40 after passing through the discrimination unit 225.

That is, when a kind of media accepted into the first space 121 or a kind of media that pass through the discrimination unit 25 and are temporarily stacked is provided in two kinds or more, the media in the second space and the temporary stacker 30 may be divided according to the kinds thereof and then temporarily stacked.

<Medium Deposit/Second deposit After Counting Process>

Figure 18:
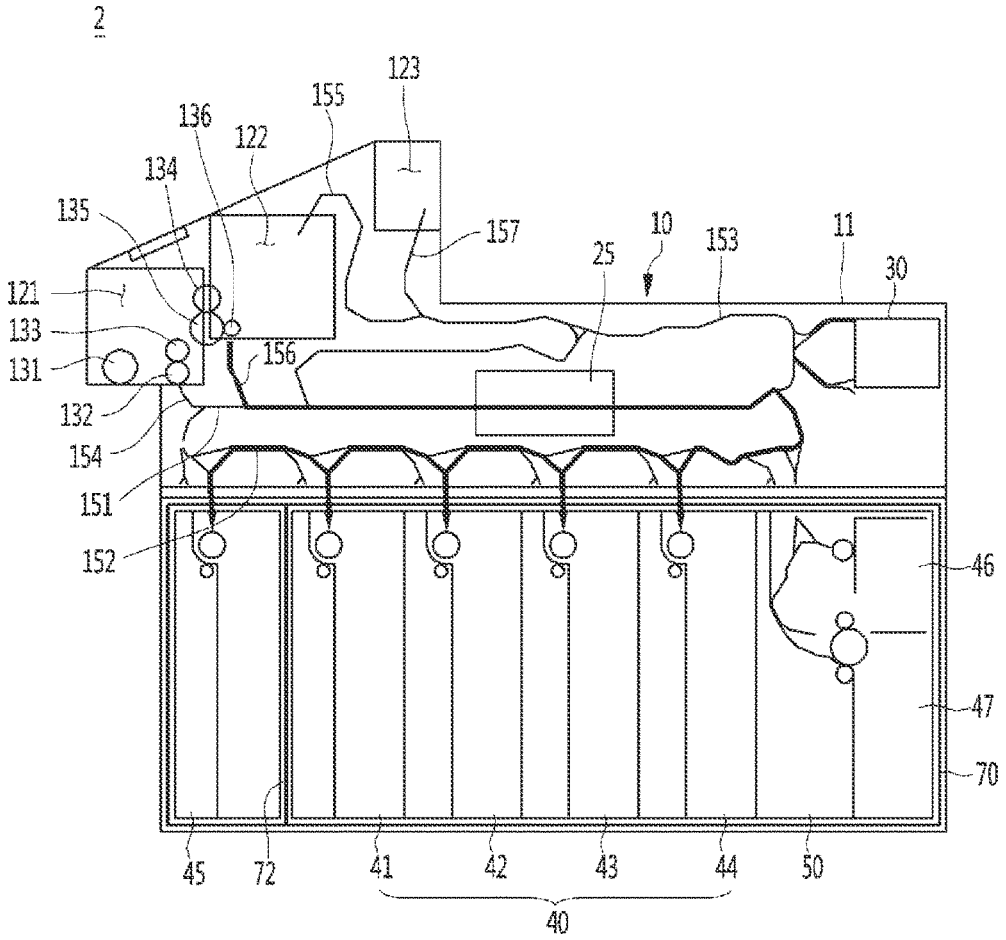
FIG. 18 is a view illustrating transfer of the medium in a deposit process or second deposit process of the counted medium that is stacked in the second space according to the second embodiment.
Figure 19:
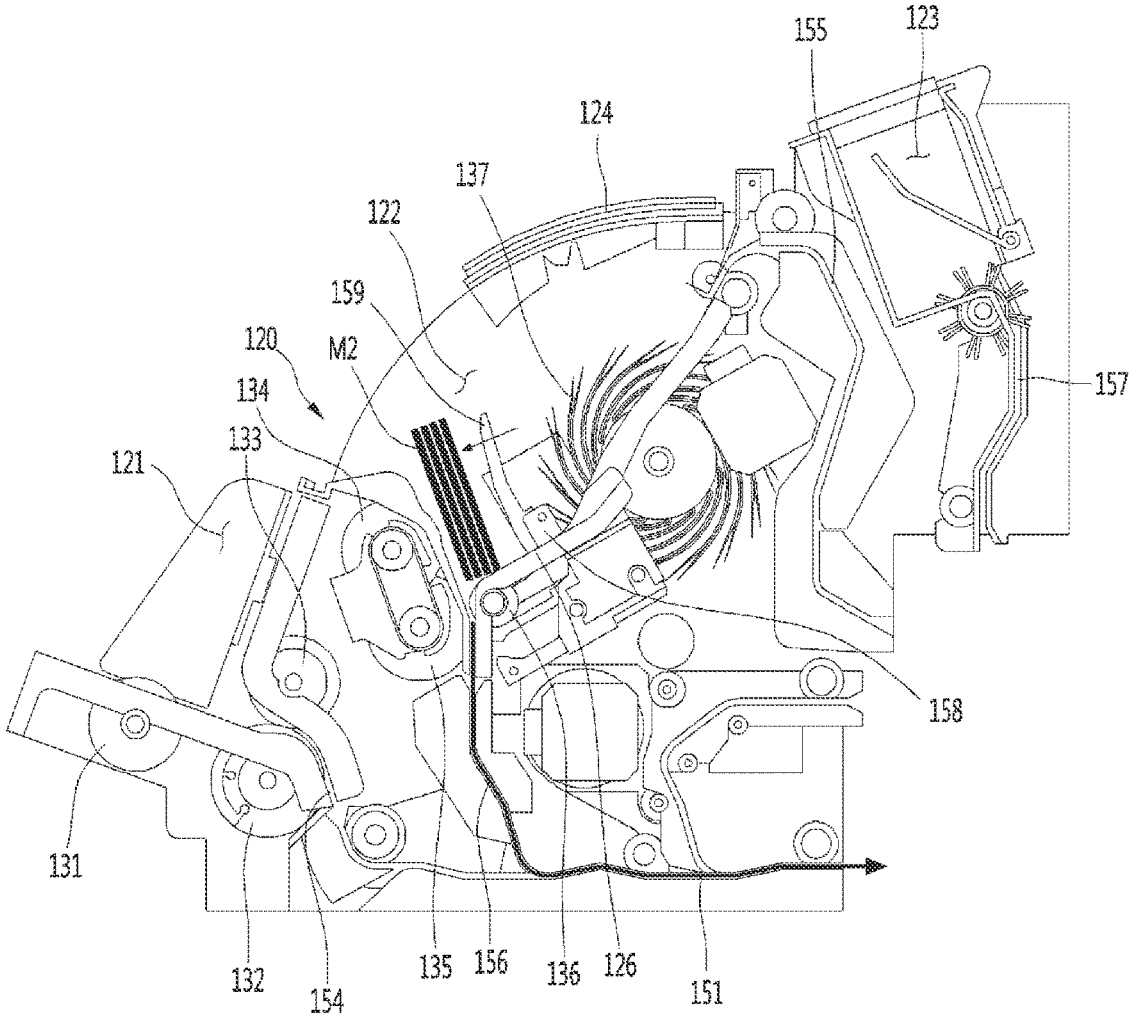
FIG. 19 is a view illustrating an operation of a medium depositing and withdrawing unit in the process of FIG. 18.
Figure 20:
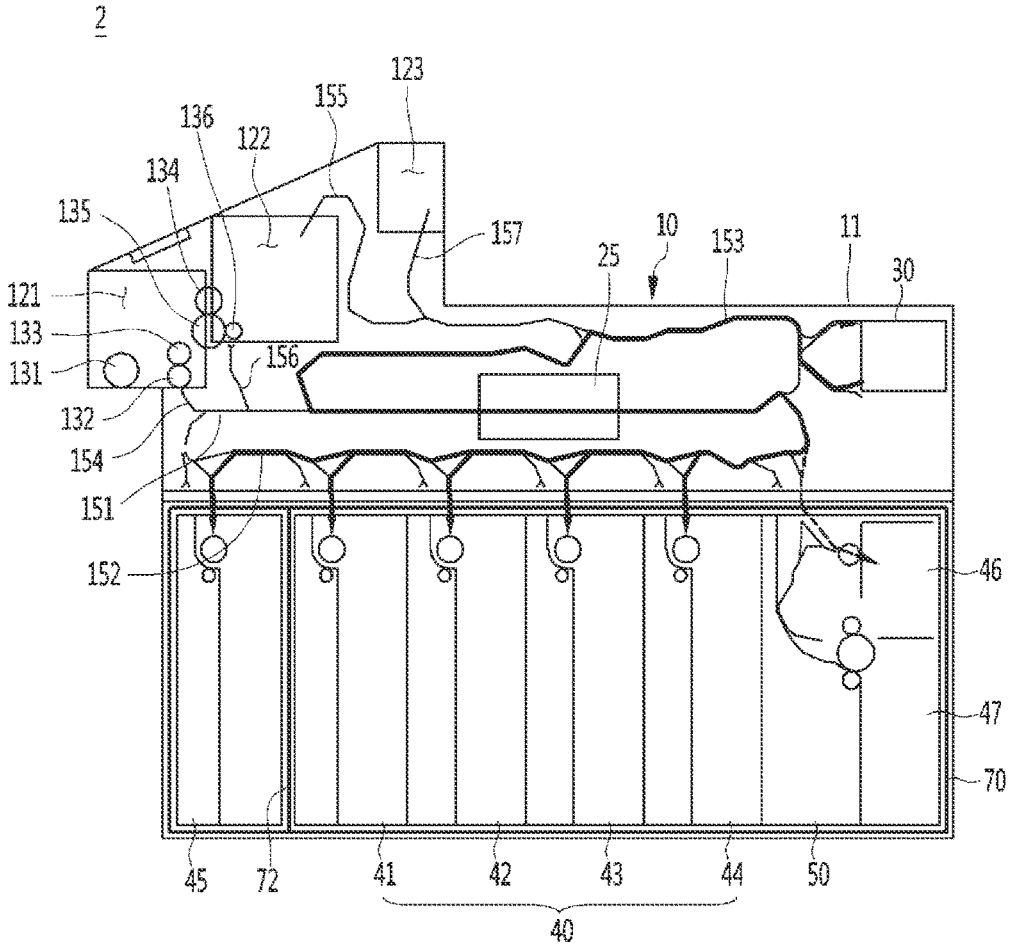
FIG. 20 is a view illustrating transfer of media stacked in a temporary stacker in the second deposit process according to the second embodiment.

FIG. 18 is a view illustrating transfer of the medium in the deposit process or second deposit process of the counted medium that is stacked in the second space according to the second embodiment, FIG. 19 is a view illustrating an operation of the medium depositing and withdrawing unit in the process of FIG. 18, and FIG. 20 is a view illustrating transfer of media stacked in a temporary stacker in the second deposit process according to the second embodiment.

Referring to FIGS. 18 to 20, after the counting process is completed, a medium M2 stacked in the second space 122 may be deposited. Also, the medium stacked in the second space 122 in the first deposit process may be deposited.

As described above, in the deposit process, the second space 122 may function as a temporary stacking space in which the media is temporarily stacked.

When a deposit command in the counting process, a deposit command after the counting process is completed, or a deposit command in the deposit process with respect to at least a portion or the whole media M2 that are stacked in the second space 122 is received, a pressing part 159 disposed in the second space 122 may operate to press the medium M2 in the second space 122 toward the second pick-up roller 134.

The pressing part 159 may be maintained in a state avoided to a predetermined position to prevent the media in the second space from interfering while the media are accepted into the second space 122. Also, while the media are separated from the second space 122, the pressing part 159 may protrude from the second space 122 to press the medium M2 in the second space 122 toward the second pick-up roller 134.

For example, the pressing part 159 may be connected to a movable part 158 to move in a direction that is substantially parallel to the support surface 126. The pressing part may be rotatably connected to the movable part 158.

In this specification, the pressing part 159 and the movable part 158 may be called a medium pressing unit. In this specification, the medium pressing unit may not be limited in constituent to the pressing part and the movable part which are described above, but be provided in various shapes. For example, the medium pressing unit may be avoided upward from the medium M2 stacked in the second space 122 and move to a rear side (a right side of the medium M2 in FIG. 19) of the medium M2 while the medium M2 is separated to press the medium M2 toward the second pick-up roller 134.

The medium M2 stacked in the second space 122 may be separated by the second separation part and then transferred to the withdrawal path 156. The medium M2 transferred to the withdrawal path 156 may be transferred along the first transfer path 151 to pass again through the discrimination unit 25. Then, the medium M2 may be transferred to the second transfer path 152 and then be stacked in the medium storage unit 40.

Here, when the medium M2 is determined as the abnormal medium after passing again through the discrimination unit 25, the medium M2 may be collected to the first cassette 46.

When the medium is stacked in each of the second space 122 and the temporary stacker 30, the second deposit process of the medium stacked in the temporary stacker 30 may be performed after the second deposit process in which the medium in the second space 122 is secondarily deposited is completed.

On the other hand, when the medium is stacked in each of the second space 122 and the temporary stacker 30, the second deposit process of the medium stacked in the second space 122 may be performed after the second deposit process in which the medium in the temporary stacker 30 is secondarily deposited is completed.

In the current embodiment, the deposit process after the counting process is completed may comprise inputting of a counting command; inputting a deposit command; and stacking the counted medium into the medium storage unit.

In the current embodiment, since the counted medium is disposed in the second space 122 that serves as the temporary stacking space, when the deposit process is performed after the counting process is completed, the medium disposed in the second space 122 may pass through the discrimination unit 25 and then be directly transferred to the medium storage unit 40 without being temporarily stacked in the temporary stacker 30.

Thus, according to the current embodiment, it may be unnecessary to take the counted medium out of the second space 122 and insert the medium again into the first space 121 when the counted medium is deposited. Thus, the user's convenience may be improved, and an unnecessary time for inserting the medium again into the first space may be reduced.

Also, when the counted medium is deposited, since the temporary stacking process is not performed, the deposit time may be reduced.

In the current embodiment, the additional function cassette 45 may be used as the collection cassette, and each of the first and second cassettes 46 and 47 may be used as the recycle cassette. In this case, the number of kinds of media that are capable of being processed by the financial device 2 may increase.

Alternatively, each of the additional function cassette 45 and the first and second cassettes 46 and 47 may be used as the recycle cassette. In this case, the number of kinds of media that are capable of being processed by the financial device 2 may be maximized. In this case, the abnormal medium may not be stacked in the temporary stacker 30.

That is, in the current embodiment, the function of the temporary stacker 30 may vary according to the used area or position of the financial device 2.

Also, a phenomenon in which a portion of first media (a medium disposed at the most left side in the drawings) of the media M2 stacked in the second space 122 is inserted below second media. In this state, when the pick-up of the medium starts by the second pick-up roller, normal pick-up may not be realized to cause pick-up impediment.

Thus, to separate the medium M2 stacked in the second space 122, when the second pick-up roller 134 rotates in one direction (a rotating direction to pick the medium up), if the transfer of the medium is not detected by the sensor provided in the transfer path within a predetermined time period, the second pick-up roller 134 may rotate at a predetermined angle in the other direction opposite to the one direction. That is, when the medium M2 is normally picked up by the second pick-up roller 134, the medium M2 picked up within the predetermined time period may be detected by the sensor provided in the transfer path. On the other hand, when the medium M2 is abnormally picked up by the second pick-up roller 134, the medium M2 picked up within the predetermined time period may not be detected by the sensor provided in the transfer path.

Thus, when the second pick-up roller 134 rotates at a predetermined angle in the other direction, the first medium inserted under the second medium may be withdrawn from the lower side of the second medium. Then, to pick the medium M2 stacked in the second space up, the second pick-up roller 134 may rotate again in one direction. Here, for example, the transfer path may be the withdrawal path 156.

<Withdrawal Process>

Figure 21:
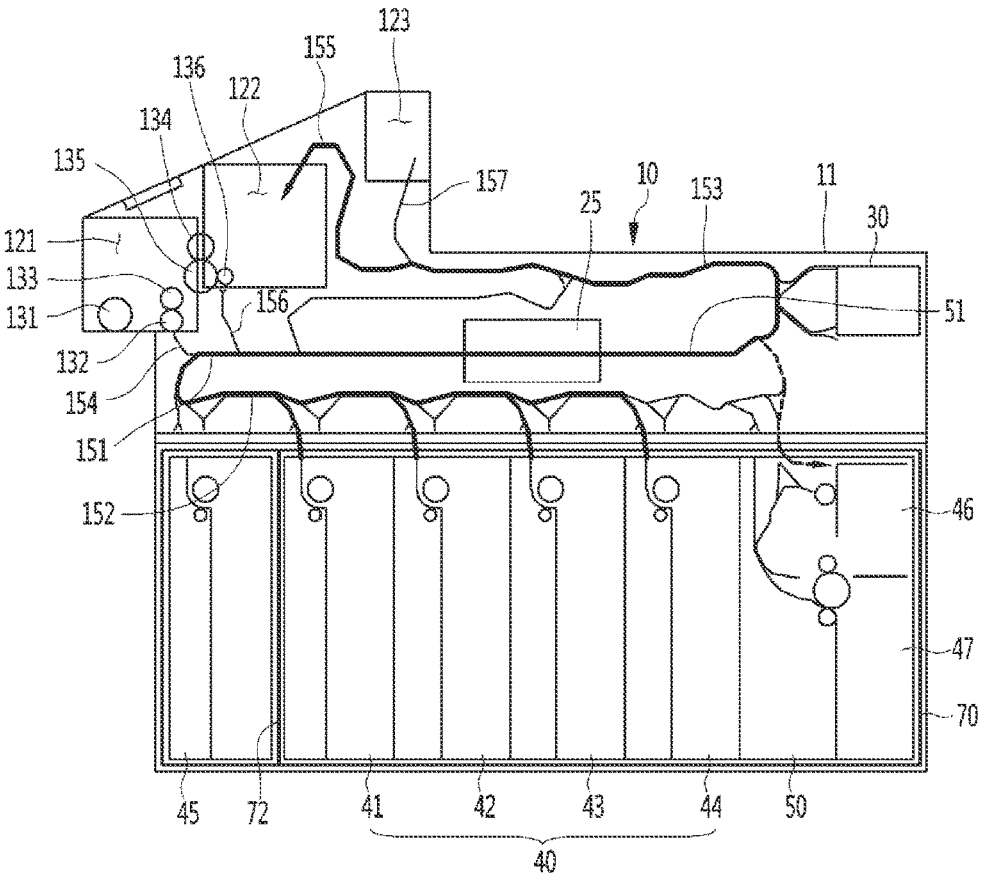
FIG. 21 is a view illustrating transfer of the medium in a withdrawal process according to the second embodiment.

FIG. 21 is a view illustrating transfer of the medium in a withdrawal process according to the second embodiment.

Referring to FIG. 21, when the medium withdrawal command is received through the user interface 15, a kind and the number of medium corresponding to the received sum of the medium to be withdrawn may be discharged from the medium storage unit 40. The medium discharged from the medium storage unit 40 may be transferred along the second transfer path 152 to pass through the discrimination module 25 while being transferred along the first transfer path 151. A medium that is recognized as the normal medium by the discrimination unit 25 may be accepted into the second space 122 through the entrance path 155 while being transferred along the third transfer path 153. On the other hand, a medium that is determined as the abnormal medium among the media passing through the discrimination unit 25 may be collected to the collection cassettes 46 and 47.

For another example, the medium that is determined as the abnormal medium among the media passing through the discrimination unit 25 may be stacked in the temporary stacker 30. Also, when the withdrawal transaction is completed, the medium may be collected to the additional function cassette 45 or the collection cassettes 46 and 47.

When the insertion of the medium to be withdrawn into the second space 122 is completed, the shutter 124 may be released in locking and/or be opened to allow the user to take the medium out of the second space 122. That is, in the withdrawal process, the second space 122 may serve as the withdrawal space in which the medium to be withdrawn is disposed.

<Non-reception Collection Process>

Figure 22:
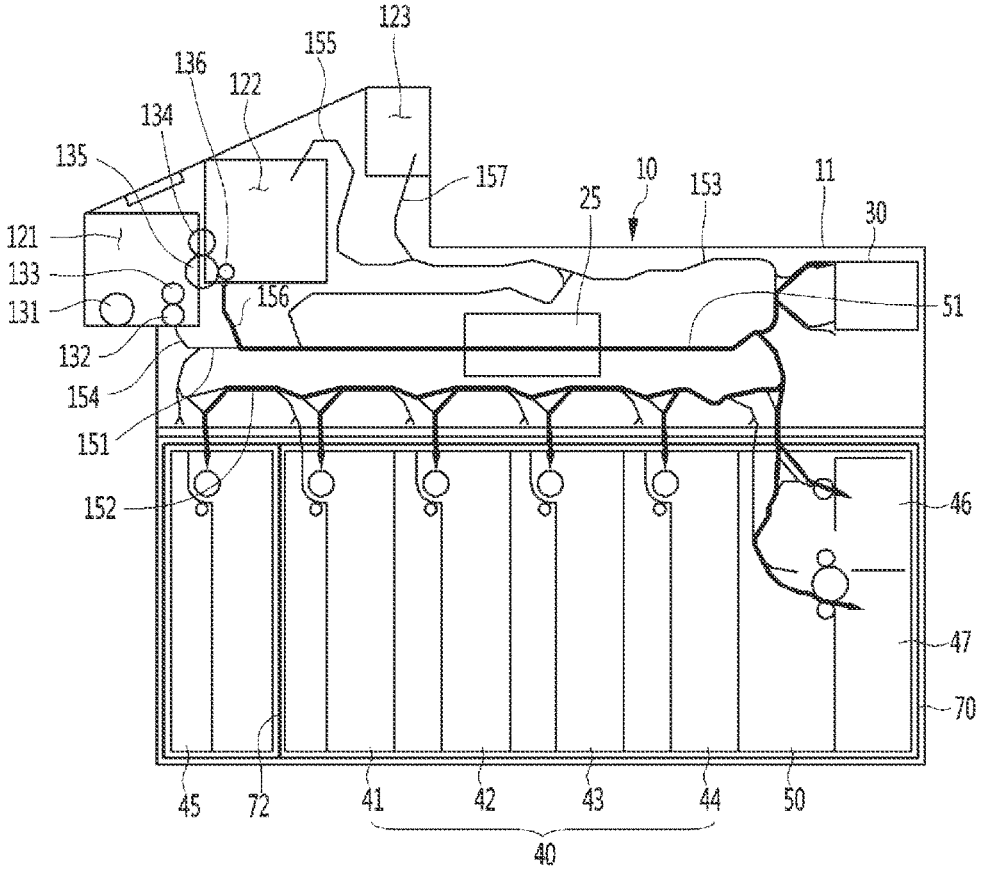
FIG. 22 is a view illustrating transfer of the medium in a non-reception process according to the second embodiment.

FIG. 22 is a view illustrating transfer of the medium in a non-reception process according to the second embodiment.

Referring to FIG. 22, if the user does not take the medium disposed in the second space 122 after the withdrawal process is completed, the medium processing apparatus 10 may automatically recover the untaken medium.

The medium that is untaken in the second space 122 may be separated by the second separation part and then transferred to the withdrawal path 156. The medium transferred to the withdrawal path 156 may pass through the discrimination module 25 while being transferred along the first transfer path 151.

The normal medium of the media passing through the discrimination unit 25 may be collected to one of the temporary stacker 30, the medium storage unit 40, the additional function cassette 45, and the collection cassettes 46 and 47.

On the other hand, the abnormal medium of the media passing through the discrimination unit 25 may be collected to one of the temporary stacker 30, the additional function cassette 45, and the collection cassettes 46 and 47.

For example, although the financial device 2 communicates with a host server, the transaction cancel may be impossible after the withdrawal transaction is completed. In this case, the untaken medium may be transferred to the temporary stacker 30. Also, the user interface 15 may receive a command for the deposit transaction with respect to the untaken medium. In this case, the untaken medium may be collected to the additional function cassette 45 or the collection cassettes 46 and 47 within the safe 70.

For another example, if the financial device 2 does not communicate with the host server, the communication with the host server may be performed, for example, a terminal for the teller. In this case, the untaken medium may be stored in one of the additional function cassette 45, the medium storage unit 40, and the collection cassettes 46 and 47 within the safe 70.

For another example, when the financial device 2 communicates with the host server so that the transaction cancel is possible after the withdrawal transaction is completed, the untaken medium after the transaction cancel may be stored in one of the additional function cassette 45, the medium storage unit 40, and the collection cassettes 46 and 47 within the safe 70.

If the user is a teller, at least two tellers may use one financial device at the same time. If one teller does not take the medium after the withdrawal process is completed, the other teller may not use the financial device unless the medium is received.

However, according to the current embodiment, the untaken medium may be automatically collected, and the next transaction may be allowable after the collection process is completed. Thus, efficiency in business when the financial device is used by at least two tellers, and also, the operation rate of the financial device may be improved.

On the other hand, the untaken medium disposed in the second space 122 may be transferred to a untaken medium collection space without passing through the discrimination unit 25.

In this specification, regardless of the term, the space in which the untaken medium is collected may be called a untaken medium collection space. That is, at least one of the additional function cassette 45, the medium storage unit 40, and the collection cassettes 46 and 47 may comprise the untaken medium collection space.

<Quick Deposit/Replenishment Using First Space>

Figure 23:
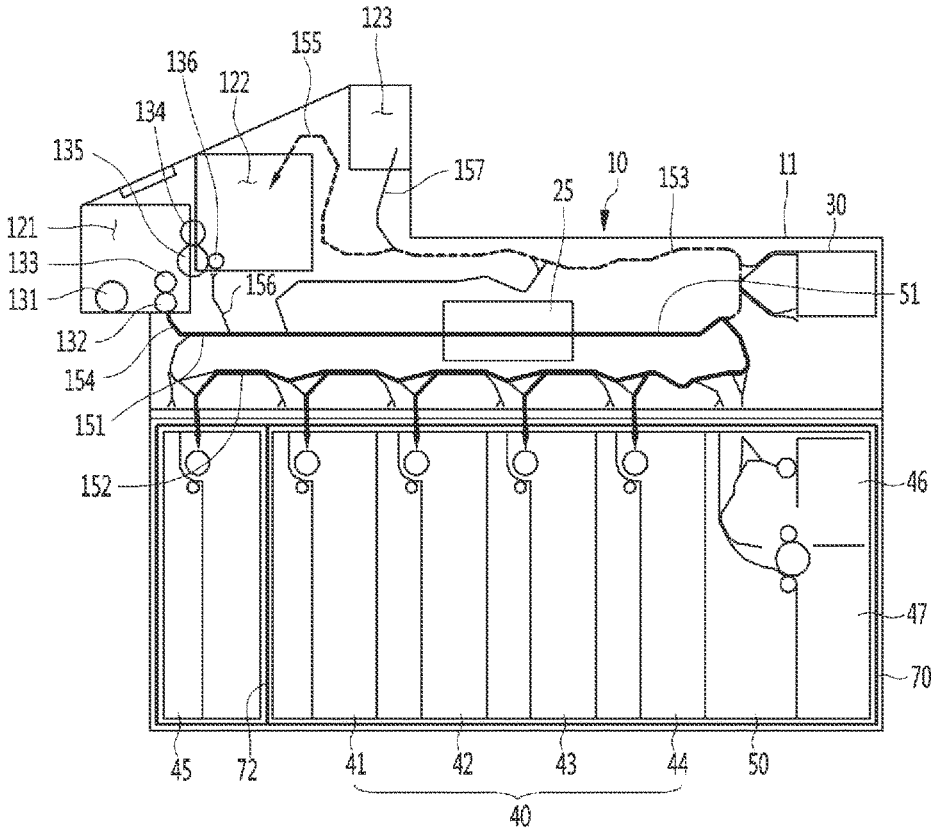
FIG. 23 is a view illustrating transfer of the medium in a quick deposit process according to the second embodiment.

FIG. 23 is a view illustrating transfer of the medium in a quick deposit process according to the second embodiment.

Referring to FIG. 23, when the user interface 15 receives a quick deposit command, the media stacked in the first space 121 may be separated into each sheet of media by the first separation unit to pass through the discrimination unit 25. The normal medium passing through the discrimination unit 25 may not be temporarily stacked, but be directly transferred and stacked into the medium storage unit 40.

On the other hand, the abnormal medium passing through the discrimination unit 25 may be transferred to the second space 122.

The medium transferred to the second space 122 may be separated into each sheet of media by the second separation part to pass again through the discrimination unit 25.

The normal medium passing through the discrimination unit 25 may be transferred and stacked into the medium storage unit 40.

On the other hand, the abnormal medium of the media passing through the discrimination unit 25 may be collected to one of the temporary stacker 30, the additional function cassette 45, the third space 123, and the collection cassettes 46 and 47.

For example, a forged medium may be transferred to the temporary stacker 30, and a medium that is not recognized by the discrimination unit 25 may be transferred to the collection cassettes 46 and 47. Also, a faulty medium may be transferred to the additional function cassette 45, and also various cases may be considered.

For another example, among the media that are determined as the abnormal media, a medium that is necessary to return to the user may be transferred to the third space 123, and a medium that is unnecessary to return the user may be transferred to at least one of the additional function cassette 45, the collection cassettes 46 and 47, and the temporary stacker 30.

In the current embodiment, the medium pressing part for pressing the stacked medium is not provided in the first space 121. On the other hand, the medium pressing part for pressing the stacked medium is provided in the second space 122. Thus, the possibility of the pick-up faulty of the medium stacked in the first space 121 may be higher that of the medium stacked in the second space 122.

In the current embodiment, even though the medium picked up from the first space 121 is determined as the abnormal medium, the medium may not be collected just, but be picked again up after being transferred to the second space 122. Thus, a collection rate of the medium may be reduced.

<Audit Process_Partial Audit>

Figure 24:
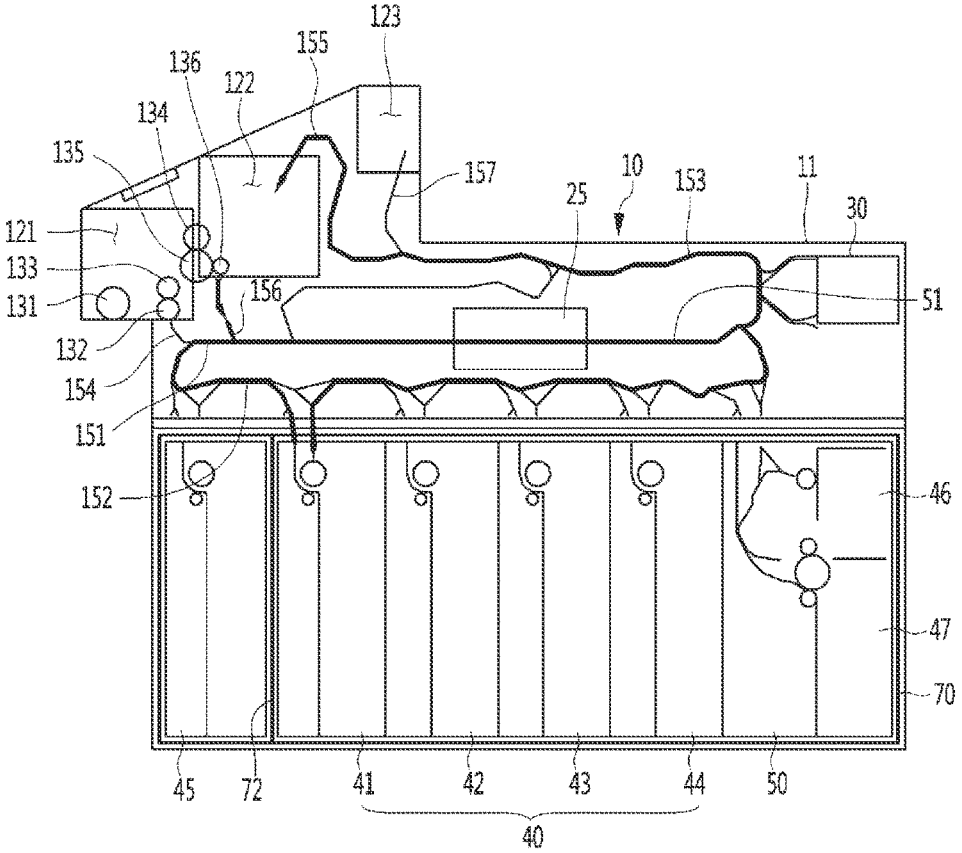
FIG. 24 is a view illustrating a process of performing audit by using a portion of media stored in a medium cassette according to the second embodiment.

FIG. 24 is a view illustrating a process of performing audit by using a portion of media stored in a medium cassette according to the second embodiment.

Referring to FIG. 24, when the today financial transaction is finished, when the today financial transaction starts, or when the user interface receives a partial audit command, the media having the predetermined number may be discharged from one medium cassette of the plurality of medium cassettes. The media discharged from the one medium cassette may be transferred to the second space 122 after passing through the discrimination unit 25. Here, in the medium audit process, the shutter 124 may be maintained in the locked state in the state in which the shutter 124 closes the second space 122.

While the media having the predetermined number pass through the discrimination unit 25, the discrimination unit 25 may recognize a serial number of each of the predetermined number of the media.

The control unit 16 may compare the serial number of each of the media having the predetermined number, which is recognized by the discrimination unit 25 with a serial number stored in the memory 17.

If the serial number of each of the media having the predetermined number does not match the serial number stored in the memory 17, the information of the serial number stored in the memory 17 may be corrected, and the corrected serial number may be stored.

Also, if at least one serial number of the serial numbers of the media having the predetermined number is not stored in the memory 17, or the serial numbers of media are stored to be inverted in order, the information stored in the memory 17 may be corrected of deleted to match the serial numbers of media stored in the actual media cassettes with the serial numbers of media, which are stored in the memory.

When the audit of the media is completed, the media stacked in the second space 122 may be separated by the second separation part to pass through the discrimination unit 25 and then be transferred again to the one medium cassette.

The financial device 2 according to the current embodiment may perform the whole audit. Since the method for settling the whole media and the transfer of the media are the same as those in FIG. 12, their detailed descriptions will be omitted.

According to the current embodiment, since the audit is performed by using the media having the predetermined number, the audit process may be simplified.

For another example, at least one medium cassette of the plurality of medium cassettes may further comprise a temporary stacking space for performing the temporary stacking function. For example, the temporary stacking space and the storing space for storing the media may be divided within the one medium cassette. In this case, the media having the predetermined number and to be audited may be transferred to the temporary stacking space within the medium cassette, and then, when the audit is completed, the media may be transferred again to the one medium cassette.

For another example, at least one medium cassette of the plurality of medium cassettes may be a multi-stage cassette having a plurality of spaces. That is, a plurality of spaces may be independently defined in the medium cassette to store the media, and the media stored in each space may be separated by the separation unit and discharged to the outside of the medium cassette.

In this case, the media having the predetermined number and to be audited may be transferred to one space of the multi-stage cassette, and then, when the audit is completed, the media may be transferred again to the one medium cassette.

When the audit of the media in the one medium cassette of the plurality of medium cassettes is completed, media in the next medium cassette may be audited.

According to the proposed embodiments, since the additional function cassette and the medium cassette are disposed in the safe, even though the transfer path is opened to repair or check the transfer path that is disposed outside the safe, the access to each of the cassettes within the safe may be blocked to improve the security.

Also, when the additional function cassette disposed in the safe is used as the cassette for the replenishment and/or the collection, the medium may be automatically replenished into the medium storage unit or automatically collected from the medium storage unit.

Also, when the additional function cassette disposed in the safe is used as the recycle cassette, since the medium is stored when the media are fully filled in the medium cassette, the operation rate of the financial device may be improved.

Also, when the additional function cassette disposed in the safe is used as the recycle cassette, the number of kinds of media that are capable of being processed by the financial device may increase, and the number of transacting media may increase.

Also, the accurate audit may be enabled by the additional function cassette disposed in the safe to improve the security.

Also, since the separation part for separating the media is disposed in the second space in which the media completely counted in the counting process are stacked, the deposit transaction may be directly performed without taking the media out of the second space after the counting process is completed.

Also, the media may be temporarily stacked, in the deposit process, in the second space that serves as the withdrawal space in the withdrawal process. Thus, since the media passing through the discrimination unit are temporarily stacked in the deposit process, when the user input the deposit cancel command, the media disposed in the second space may be taken out of the second space without being transferred to other modules, thereby reducing the transaction time.

Also, since the number of media that are capable of being temporarily stacked when the transaction is performed once increases, the deposit transaction number may be reduced, and thus, the transaction time taken to deposit the whole media may be reduced.

Also, since the untaken medium is automatically collected, the financial transaction may be performed after the collection process is completed to improve the efficiency in business and the operation rate of the financial device.

Also, one point of the first space, one point of the second space, and one point of the third space may be disposed in one line, and the line may be inclined at a predetermined angle with respect to the horizontal line. As described above, due to the arrangement of the first to third spaces, the user's moving line may be shorter and convenient.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

What is claimed is:

1. A financial device comprising:

an upper module;

a lower module disposed under the upper module; and a controller, wherein the upper module comprises:

a medium depositing and withdrawing unit through which media to be counted, media to be deposited, and media to be withdrawn are accepted and withdrawn; and a discrimination unit connected to the medium depositing and withdrawing unit through a transfer path, wherein the lower module comprises an additional function cassette and a medium storage unit which are capable of storing media, wherein, through the additional function cassette and the medium storage unit, the financial device is operated in one of first and second modes;

wherein the controller is configured to convert one of the first and second modes to the other mode of the first and second modes, wherein in the first mode, the controller is configured to control the financial device in the deposit process, such that a predetermined number of media are stacked in the medium storage unit, and media that are not stored in the medium storage unit are stored in the additional function cassette;

wherein in the second mode, the controller is configured to control the financial device such that information of the media stored in the medium storage unit is discriminated and then compared to information stored in a memory to perform an audit;

wherein the medium storage unit comprises at least one medium cassette, and wherein in the audit, the controller is configured to control the financial device such that after all the media stored in the at least one medium cassette are transferred to the additional function cassette, the media transferred to the additional function cassette pass through the discrimination unit and are transferred back to the at least one medium cassette.

2. The financial device of claim 1, wherein the controller is configured to control the financial device such that the media stored in the additional function cassette are replenished to the medium storage unit when a number of the media stacked in the medium storage unit is less than the number of the predetermined number of media.

3. The financial device of claim 1, wherein the discrimination unit recognizes identification information of medium, and wherein in the audit process, the controller is configured to control the financial device such that the identification information acquired by the discrimination unit is compared to the information stored in the memory.

4. The financial device of claim 1, wherein the financial device is capable of being operated in a third mode, wherein in the third mode, the controller is configured to control the financial device such that media discharged from the at least one medium cassette are transferred to the additional function cassette without passing through the discrimination unit.

5. The financial device of claim 4, further comprising a sensor provided in a transfer path connecting the additional function cassette to the at least one medium cassette to count number of media collected at the additional function cassette.

6. The financial device of claim 1, wherein the financial device is capable of being operated in a fourth mode, and wherein in the fourth mode, the controller is configured to control the financial device such that media to be replenished that are stored in the additional function cassette are discharged from the additional function cassette to pass through the discrimination unit and are transferred to and replenished in the at least one medium cassette.

7. The financial device of claim 1, wherein the controller is configured to control the financial device such that a medium that is determined as an abnormal medium by the discrimination unit is stored in the additional function cassette, and wherein the medium stored in the additional function cassette is transferred to the medium depositing and withdrawing unit after passing through the discrimination unit.

8. The financial device of claim 1, wherein the lower module further comprises a safe in which the additional function cassette and the medium storage unit are accommodated.

9. The financial device of claim 1, wherein the medium depositing and withdrawing unit comprises:

a first space into which the media to be counted are accepted;

a first separation part for separating the media in the first space;

a second space in which the counted media are stacked; and a second separation part for separating the media in the second space, wherein the counted media stacked in the second space pass through the discrimination unit and are transferred along the transfer path and stored in the medium storage unit to be deposited.

10. The financial device of claim 9, wherein, in the process of depositing the counted media, the counted media are transferred to the medium storage unit without being temporarily stacked.

11. The financial device of claim 1, wherein the medium depositing and withdrawing unit comprises:

a first space into which the media to be deposited are accepted;

a first separation part for separating the media in the first space;

a second space in which the media passing through the discrimination unit and temporarily stacked are stacked in the deposit process, and the media passing through the discrimination unit are stacked as media to be withdrawn; and a second separation part for separating the media in the second space, wherein the media temporarily stacked in the second space pass through the discrimination unit and are transferred along the transfer path and stored in the medium storage unit.

12. The financial device of claim 11, wherein the transfer path comprises:

a first transfer path passing through the discrimination unit;

a connection path connecting the first space to the first transfer path; and a withdrawal path connecting the second space to the first transfer path.

13. The financial device of claim 12, wherein the transfer path further comprises:

a third transfer path connected to the first transfer path;

a second transfer path connected to the first transfer path and the medium storage unit; and an entrance path for guiding media in the third transfer path to the second space.

14. The financial device of claim 11, wherein the medium depositing and withdrawing unit further comprises:

a support surface supporting the media in the second space;

a stack wheel arranged to guide media accepted by rotations thereof to the support surface; and a medium pressing part inhibiting media from interference in a process where the media are accepted into the second space, the medium pressing part being disposed at a rear side of the media to press the media in the second space while the media in the second space are separated.

15. A financial device comprising:

a medium depositing and withdrawing unit through which media to be counted, media to be deposited, and media to be withdrawn are accepted and withdrawn;

a discrimination unit connected to the medium depositing and withdrawing unit through a transfer path;

a medium storage unit capable of storing media;

an additional function cassette; and a controller;

wherein, through the additional function cassette and the medium storage unit, the controller is configured to control the financial device to be operated in one of first to third modes;

wherein in the first mode, the controller is configured to control the financial device in a deposit process, such that a predetermined number of media are stacked in the medium storage unit and media that are not stored in the medium storage unit are stored in the additional function cassette;

wherein in the second mode, the controller is configured to control the financial device such that information of the media stored in the medium storage unit is discriminated and then compared to information stored in a memory to perform an audit;

wherein in the third mode, the controller is configured to control the financial device such that the media in the medium storage unit are automatically collected at the additional function cassette and the media in the additional function cassette are replenished into the medium storage unit;

wherein the medium storage unit comprises at least one medium cassette, wherein in the audit, the controller is configured to control the financial device such that after all the media stored in the at least one medium cassette are transferred to the additional function cassette, the media transferred to the additional function cassette pass through the discrimination unit and are transferred back to the at least one medium cassette; and wherein the medium depositing and withdrawing unit comprises:

a first space into which the media to be deposited are accepted;

a first separation part for separating the media in the first space;

a second space in which the media passing through the discrimination unit are temporarily stacked in the deposit process, and the media passing through the discrimination unit are stacked as media to be withdrawn;

a second separation part for separating the media in the second space;

a support surface to support the media in the second space; and a medium pressing part inhibiting the media from interference in a process where the media are accepted into the second space, the medium pressing part being disposed at a rear side of the media to press the media in the second space while the media in the second space are separated;

wherein the media temporarily stacked in the second space pass through the discrimination unit and are transferred along the transfer path and stored in the medium storage unit.

* * * * *